US006354346B2

(12) United States Patent
Arsenault et al.

(10) Patent No.: US 6,354,346 B2
(45) Date of Patent: Mar. 12, 2002

(54) GRAVITY FEED FLUID DISPENSING VALVE

(75) Inventors: Cathleen M. Arsenault, Fridley; John J. Dyer, Shoreview, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/797,322

(22) Filed: Mar. 1, 2001

Related U.S. Application Data

(62) Division of application No. 09/422,752, filed on Oct. 21, 1999, now Pat. No. 6,223,791.

(51) Int. Cl.[7] ..... B65B 1/04

(52) U.S. Cl. ..... 141/291; 141/302; 141/307; 141/351; 222/548

(58) Field of Search ..... 141/59, 290–292, 141/295, 301, 302, 307, 351, 360, 362, 364, 366, 375, 379; 222/548, 482, 484; 137/588; 251/127; 215/309; 220/253, 374

(56) References Cited

U.S. PATENT DOCUMENTS

| | | | |
|---|---|---|---|
| 76,483 | A | 4/1868 | Marcy |
| 147,272 | A | 2/1874 | Kittoe |
| 196,437 | A | 10/1877 | Downes |
| 232,362 | A | 9/1880 | Newton |
| 251,923 | A | 1/1882 | Newton |
| 273,831 | A | 3/1883 | Ely |
| 500,260 | A | 6/1893 | Carter |
| 539,460 | A | 5/1895 | Webster |
| 585,327 | A | 6/1897 | Guttenberg |
| 654,016 | A | 7/1900 | Miller |
| 694,477 | A | 3/1902 | Howland |

(List continued on next page.)

FOREIGN PATENT DOCUMENTS

| | | |
|---|---|---|
| CH | 365660 | 12/1962 |
| DE | 102353 | 8/1898 |
| DE | 1136906 | 9/1962 |
| DE | 2557961 | 12/1975 |
| EP | 0 010 912 | 5/1980 |

(List continued on next page.)

OTHER PUBLICATIONS

Hydro Systems Company document entitled Hydro® Omni-Clean Streamline Series, 4 pages (Feb. 1990).

Johnson, K.J., "Make an Easy–to–Build Butterfly Valve", *Chemical Engineering Handbook,* pp. 107 (1959).

(List continued on next page.)

*Primary Examiner*—Steven O. Douglas
(74) *Attorney, Agent, or Firm*—Steven C. Bruess; Michaele A. Hakamaki; Peter L. Olson

(57) ABSTRACT

A dispensing valve cap mountable to a bottle is provided with a first valve part having a tubular portion having an air inlet, the first valve part further including a fluid outlet spaced apart along a longitudinal axis of the tubular portion to form a constant head valve for dispensing fluid from the bottle. A second valve part of the valve movably mounted to the first valve part includes a tubular portion for simultaneously closing both the air inlet and the fluid outlet of the first valve part when fluid dispensing is not desired. The second valve part further includes an air inlet alignable with the air inlet of the tubular portion when fluid dispensing is desired. The dispensing valve cap controls fluid flow from the bottle. The bottle with the valve cap is useable with a dispenser assembly for mixing a concentrated fluid from the bottle with a dilutant. A tamper resistant lock prevents undesired rotation of the second valve part relative to the first valve part. The tamper resistant lock is deactivated upon insertion of the valve cap into the dispenser assembly.

7 Claims, 18 Drawing Sheets

U.S. PATENT DOCUMENTS

| | | | | | |
|---|---|---|---|---|---|
| 705,160 | A | | 7/1902 | Swanson | |
| 815,158 | A | | 3/1906 | Graham et al. | |
| 857,056 | A | | 6/1907 | Harmon et al. | |
| 1,026,145 | A | | 5/1912 | Blackman et al. | |
| 1,054,146 | A | | 2/1913 | Smirle | |
| 1,221,350 | A | | 4/1917 | Miller | |
| 1,265,381 | A | | 5/1918 | Ramey | |
| 1,278,764 | A | | 9/1918 | Seiler | |
| 1,307,828 | A | | 6/1919 | Miller | |
| 1,310,405 | A | | 7/1919 | Deppermann | |
| 1,368,703 | A | | 2/1921 | Czerny | |
| 1,519,347 | A | | 12/1924 | Anderson | |
| 1,581,072 | A | | 4/1926 | Lumsden | |
| 1,676,711 | A | | 7/1928 | Reap | |
| 1,913,393 | A | | 6/1933 | Jones | |
| 2,036,310 | A | | 4/1936 | Werder | |
| 2,051,513 | A | | 8/1936 | Bingham | |
| 2,165,570 | A | | 7/1939 | Olson et al. | |
| 2,165,825 | A | | 7/1939 | Von Bulzingslowen | |
| 2,239,921 | A | | 4/1941 | Majewski, Jr. | |
| 2,328,110 | A | | 8/1943 | Thompson et al. | |
| 2,364,400 | A | | 12/1944 | Stewart et al. | |
| 2,401,914 | A | | 6/1946 | DiPietro | |
| 2,408,664 | A | | 10/1946 | Lloyd | |
| 2,463,922 | A | | 3/1949 | Turner | |
| 2,500,199 | A | | 3/1950 | Nesset | |
| 2,520,003 | A | | 8/1950 | Gilmore | |
| 2,537,119 | A | | 1/1951 | Bauerlein et al. | |
| 2,542,350 | A | | 2/1951 | Paulsen | |
| 2,543,390 | A | | 2/1951 | Van Vliet et al. | |
| 2,558,700 | A | | 6/1951 | Burgess | |
| 2,698,703 | A | | 1/1955 | Harvey | |
| 2,718,985 | A | | 9/1955 | Tamminga | |
| 2,724,535 | A | | 11/1955 | Day et al. | |
| 2,749,096 | A | | 6/1956 | Cole | |
| 2,754,999 | A | | 7/1956 | Bauerlein | |
| 2,765,956 | A | | 10/1956 | Schmidtke | |
| 2,778,545 | A | | 1/1957 | Sapia | |
| 2,785,833 | A | | 3/1957 | Bauerlein et al. | |
| 2,841,313 | A | | 7/1958 | Beall, Jr. | |
| 2,857,084 | A | | 10/1958 | Harris | |
| 2,880,912 | A | | 4/1959 | Fisher | |
| 2,969,896 | A | | 1/1961 | Lerner | |
| 2,989,243 | A | | 6/1961 | Turak | |
| 3,074,700 | A | | 1/1963 | Buttner, Sr. et al. | |
| 3,086,683 | A | | 4/1963 | Loper | |
| 3,142,320 | A | | 7/1964 | Olson | |
| 3,143,255 | A | | 8/1964 | Leeds | |
| 3,225,950 | A | | 12/1965 | Josephsen et al. | |
| 3,225,970 | A | | 12/1965 | Rooney | |
| 3,258,166 | A | | 6/1966 | Kuckens | |
| 3,292,527 | A | | 12/1966 | Stasse | |
| 3,292,822 | A | | 12/1966 | Growder et al. | |
| D207,069 | S | | 2/1967 | Stettler | |
| 3,325,844 | A | | 6/1967 | Lampe | |
| 3,326,417 | A | | 6/1967 | Tinsley | |
| 3,341,073 | A | | 9/1967 | Arps et al. | |
| 3,357,605 | A | | 12/1967 | Chadfield | |
| 3,384,276 | A | | 5/1968 | Henningfield | |
| 3,396,871 | A | | 8/1968 | McCann | |
| 3,401,850 | A | | 9/1968 | Anderson | |
| 3,439,843 | A | | 4/1969 | Corsette | |
| 3,455,332 | A | | 7/1969 | Cornelius | |
| 3,520,451 | A | | 7/1970 | Ashizawa | |
| 3,536,500 | A | | 10/1970 | Cleereman et al. | |
| 3,606,096 | A | | 9/1971 | Campbell | |
| 3,618,905 | A | | 11/1971 | Primus | |
| 3,628,444 | A | | 12/1971 | Mazza | |
| 3,658,216 | A | | 4/1972 | Schwartzman | |
| 3,664,550 | A | | 5/1972 | Carothers et al. | |
| 3,669,315 | A | | 6/1972 | Kuckens | |
| 3,685,694 | A | | 8/1972 | Ianelii | |
| 3,690,520 | A | | 9/1972 | Sarris | |
| 3,782,610 | A | | 1/1974 | Gilbert | |
| 3,800,826 | A | | 4/1974 | McCann | |
| 3,834,596 | A | | 9/1974 | Brady et al. | |
| 3,843,021 | A | | 10/1974 | Schieser | |
| 3,887,116 | A | | 6/1975 | Ishikawa et al. | |
| 3,941,171 | A | | 3/1976 | Ogle | |
| 3,986,642 | A | | 10/1976 | Selvia et al. | |
| 3,991,219 | A | | 11/1976 | Kuckens | |
| 4,096,971 | A | | 6/1978 | Kuckens | |
| 4,109,829 | A | | 8/1978 | Kuckens et al. | |
| 4,113,129 | A | | 9/1978 | Cambio, Jr. | |
| 4,121,507 | A | | 10/1978 | Kuckens | |
| 4,125,334 | A | | 11/1978 | Jones | |
| 4,141,461 | A | | 2/1979 | LaChance | |
| 4,176,694 | A | * | 12/1979 | Dickerson | 141/95 |
| 4,248,335 | A | | 2/1981 | Cornelius et al. | |
| 4,270,673 | A | | 6/1981 | Rodth | |
| 4,328,909 | A | | 5/1982 | Jeans | |
| 4,344,459 | A | | 8/1982 | Nelson | |
| 4,355,735 | A | | 10/1982 | Whorton, III et al. | |
| 4,363,424 | A | | 12/1982 | Holben et al. | |
| 4,378,079 | A | | 3/1983 | Kuckens | |
| 4,408,701 | A | | 10/1983 | Jeans | |
| 4,421,804 | A | | 12/1983 | Mori et al. | |
| 4,457,343 | A | | 7/1984 | Zukausky | |
| 4,488,584 | A | | 12/1984 | Hestehave et al. | |
| 4,520,950 | A | | 6/1985 | Jeans | |
| 4,523,697 | A | | 6/1985 | Jeans | |
| 4,555,371 | A | | 11/1985 | Jeans | |
| 4,564,483 | A | | 1/1986 | Jeans | |
| 4,570,830 | A | | 2/1986 | Jeans | |
| RE32,231 | E | | 8/1986 | Kuckens et al. | |
| 4,613,063 | A | | 9/1986 | Wright | |
| 4,624,395 | A | | 11/1986 | Baron et al. | |
| 4,637,439 | A | | 1/1987 | Jeans | |
| 4,660,742 | A | | 4/1987 | Ozdemir | |
| 4,664,292 | A | | 5/1987 | Jeans | |
| 4,691,822 | A | | 9/1987 | Malancon, Jr. | |
| 4,712,713 | A | | 12/1987 | Karlis et al. | |
| D298,514 | S | | 11/1988 | Dole et al. | |
| 4,802,610 | A | | 2/1989 | Cheek et al. | |
| 4,805,793 | A | | 2/1989 | Brandt et al. | |
| 4,805,808 | A | | 2/1989 | Larson | |
| 4,865,211 | A | | 9/1989 | Hollingsworth | |
| 4,874,023 | A | | 10/1989 | Ulm | |
| D304,552 | S | | 11/1989 | Lippman | |
| 4,911,212 | A | | 3/1990 | Burton | |
| 4,993,565 | A | | 2/1991 | Ota et al. | |
| 5,042,698 | A | | 8/1991 | Fessell | |
| 5,067,622 | A | | 11/1991 | Garver et al. | |
| 5,123,554 | A | | 6/1992 | Arvidson et al. | |
| 5,141,121 | A | | 8/1992 | Brown et al. | |
| 5,147,615 | A | | 9/1992 | Bird et al. | |
| D330,483 | S | | 10/1992 | Plester et al. | |
| D331,516 | S | | 12/1992 | Waring | |
| 5,222,615 | A | | 6/1993 | Ota et al. | |
| 5,224,614 | A | | 7/1993 | Bono et al. | |
| 5,224,854 | A | | 7/1993 | Ansquer | |
| 5,251,789 | A | | 10/1993 | Jeans | |
| D341,775 | S | | 11/1993 | Wolde et al. | |
| D342,176 | S | | 12/1993 | Steiner et al. | |
| 5,425,404 | A | * | 6/1995 | Dyer | 141/351 |
| 5,435,451 | A | | 7/1995 | Dyer | |
| D369,110 | S | | 4/1996 | Dyer | |
| 5,715,877 | A | * | 2/1998 | Sandor | 141/307 |
| 6,223,791 | B1 | * | 5/2001 | Arsenault et al. | 141/291 |

FOREIGN PATENT DOCUMENTS

| | | |
|---|---|---|
| EP | 0 356 829 | 3/1990 |
| FR | 1 174 882 | 3/1959 |
| FR | 2 373 486 | 7/1978 |
| GB | 428722 | 5/1935 |
| GB | 631170 | 10/1949 |
| GB | 635966 | 4/1950 |
| GB | 659764 | 10/1951 |
| GB | 797340 | 7/1958 |
| GB | 1049118 | 11/1966 |
| GB | 1367814 | 9/1974 |
| GB | 1514404 | 6/1978 |
| GB | 1534361 | 12/1978 |
| GB | 1534362 | 12/1978 |
| GB | 1537699 | 1/1979 |
| GB | 2030962 A | 4/1980 |
| GB | 2037255 A | 7/1980 |
| GB | 2103296 A | 2/1983 |
| WO | WO 90/08098 | 7/1990 |
| WO | WO 94/24040 | 10/1994 |
| WO | WO 99/18026 | 4/1999 |
| WO | WO 99/28045 | 6/1999 |

OTHER PUBLICATIONS

Photographs of a dispensing valve by Champion (Date Unknown).

Sodamate Instruction Manual for the Care and Use of Your Carbonated beverage Dispenser, 10 pages (Date Unknown).

* cited by examiner

GRAVITY FEED FLUID DISPENSING VALVE

This is a divisional of application Ser. No. 09/422,752, now U.S. Pat. No. 6,223,791, filed Oct. 21, 1999.

FIELD OF THE INVENTION

This invention relates generally to systems for dispensing fluids, and more particularly to valve caps and bottles for use in gravity feed fluid dispensing systems.

BACKGROUND OF THE INVENTION

Gravity feed fluid dispensing systems are known for dispensing a concentrated fluid for mixing with a dilutant. An example of such a system is shown in U.S. Pat. No. 5,425,404 issued Jun. 20, 1995 Minnesota Mining & Manufacturing Company of St. Paul, Minn., entitled, "Gravity Feed Fluid Dispensing System." U.S. Pat. No. 5,435,451 issued Jul. 25, 1995, and U.S. Pat. No. Des. 369,110 issued Apr. 23, 1996, both to Minnesota Mining & Manufacturing Company relate to a bottle for use in the gravity feed fluid dispensing system of U.S. Pat. No. 5,425,404.

Generally, the gravity feed fluid dispensing system of U.S. Pat. No. 5,425,404 includes an inverted bottle containing concentrated fluid, with an opening closed off by a valve cap. The system further includes a dispenser assembly which cooperates with the bottle and the valve cap during use. The valve cap controls the flow of the concentrated fluid from the bottle into the dispenser assembly for mixing with dilutant, such as water. The concentrate may be any of a wide variety of material, such as cleaning fluids, solvents, disinfectants, insecticides, herbicides, or the like. The diluted fluid exits the dispenser assembly into a container, such as a bucket or spray bottle, for use as desired.

Various concerns arise in connection with the valve cap. One concern is that the valve cap allow for metering of the concentrate from the bottle so that a proper ratio of the fluids results. Related concerns are that the valve cap only allow dispensing of the concentrate at the desired time, and that the valve cap be easy to use. Cost of the valve is also a concern since it is often desirable that the bottle with the valve cap be disposable after use. A further concern is whether any features are provided with the valve cap to prevent or deter undesired or inadvertent dispensing. There is a need in the art for further valve caps which address the above concerns, and other concerns.

SUMMARY OF THE INVENTION

One aspect of the present invention concerns a dispensing valve cap for use with a bottle containing fluid for dispensing the fluid in a gravity feed fluid dispensing system where the valve cap includes two valve parts. A first valve part is mountable to the bottle, and a second valve part is movably mounted to the first valve part along a longitudinal axis of the first valve part. The first and second valve parts form a fluid outlet and an air inlet.

In the preferred embodiment, the first valve part includes a tubular portion which includes an air inlet aperture. The first valve part further preferably defines a fluid outlet aperture spaced from the air inlet aperture along the longitudinal axis. The second valve part includes a mating portion adapted to cooperate with the first valve part to open and close the air inlet aperture of the first valve part. The tubular portion of the first valve part includes a circumferential seal positioned between the air inlet aperture and the end mountable to the bottle. The second valve part defines an aperture alignable with the air inlet aperture of the first valve part to allow air flow to enter the bottle. The tubular portion of the second valve part has an inside surface sealably engaged by the circumferential seal of the first valve part to prevent air flow communication between the air inlet aperture of the first valve part and the aperture of the second valve part when the valve cap is in the closed position. The second valve part preferably includes a fluid outlet aperture which cooperates with the fluid outlet aperture of the first valve part to define the fluid flow path through the valve cap.

A further aspect of the present invention concerns a tamper resistant dispensing valve cap for use with a bottle containing fluid for dispensing the fluid in a gravity feed fluid dispensing system where the valve cap includes two parts which define a fluid outlet and an air inlet. A first valve part is mountable to the bottle and includes at least one locking tab. A second valve part is rotatably mounted to the first valve part and includes a mating portion adapted to cooperate with the first valve part to open and close the air inlet and the fluid outlet of the valve cap. The second valve part includes a locking notch. The first valve part defines a longitudinal axis. The locking tab is movable in a direction of the longitudinal axis. The locking tab is positionable in the locking notch to lock the second valve part and the first valve part from relative rotation. The locking tab is positionable out of the locking notch to permit rotation of the second valve part. The air inlet and the fluid outlet of the valve cap are open when the tab is positioned out of the notch and the first and second valve parts are rotated relative to one another. The air inlet and the fluid outlet of the valve cap are closed when the tab is positioned in the notch.

The present invention also relates to a method of dispensing fluid from a bottle including rotating and longitudinally moving one tubular member of a valve on the bottle relative to another tubular member to simultaneously open an air inlet through the tubular members, and a fluid outlet of the valve. The fluid is dispensed from the bottle under gravity, and air enters the bottle from the atmosphere. The dispensed fluid is mixed with dilutant. The one tubular member is rotated and longitudinally moved relative to the other to simultaneously close the air inlet and the fluid outlet of the valve at the desired time to stop dispensing.

A further method includes providing a bottle containing fluid therein, with the bottle having a tamper resistant valve in fluid communication with an interior of the bottle. The method further includes mounting the bottle to a dispenser assembly, engaging a longitudinally movable locking tab of the valve with the dispenser assembly to unlock the valve during mounting of the bottle to the dispenser assembly, and rotating a first portion of the unlocked valve relative to a second portion of the valve. The fluid is dispensed from the bottle under gravity through the unlocked and rotated valve, and air is allowed to enter the bottle from the atmosphere. The fluid dispensed from the bottle is mixed with dilutant supplied by the dispenser assembly.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE INVENTION

Figure 1:
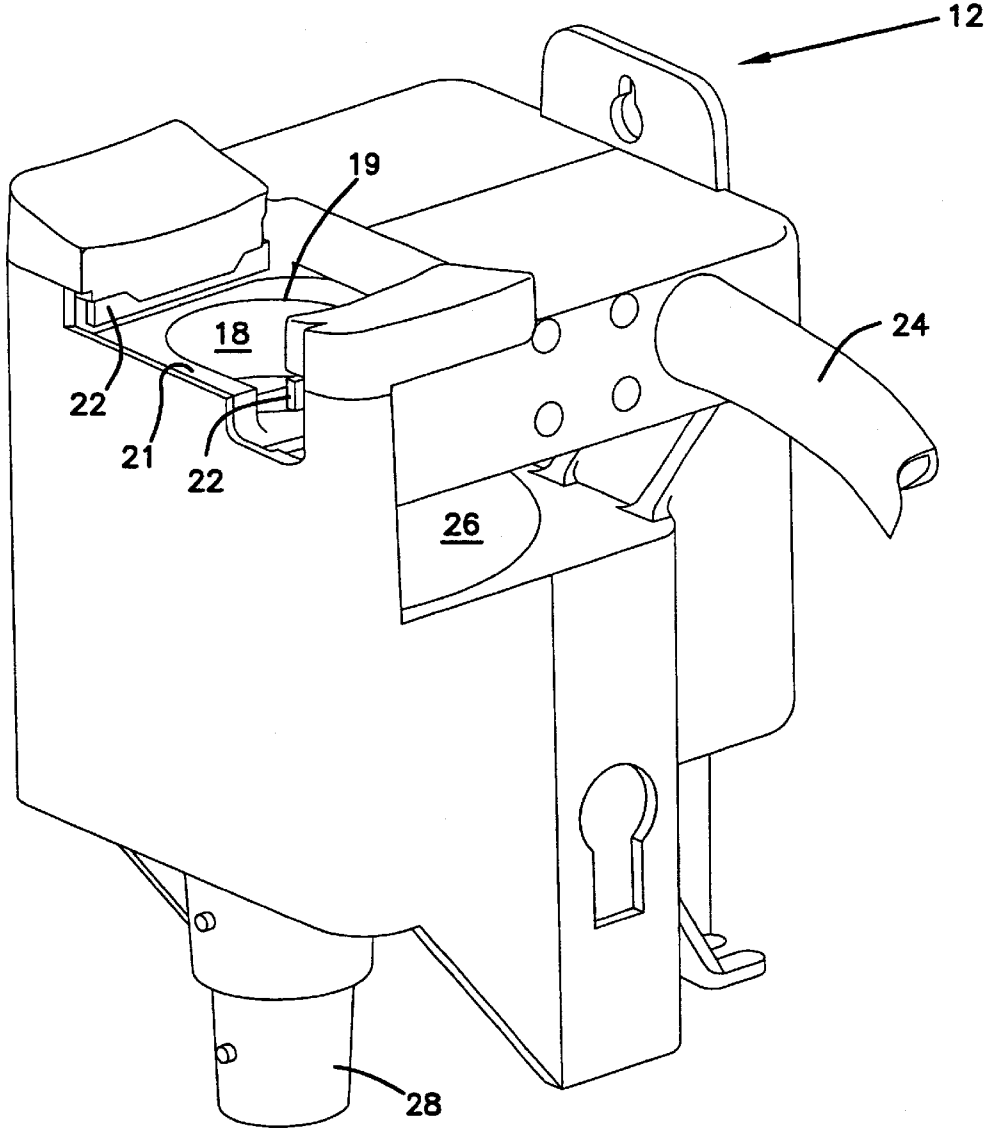
FIG. 1 PRIOR ART
FIG. 1 is a perspective view of a prior art dispenser assembly.
Figure 2:
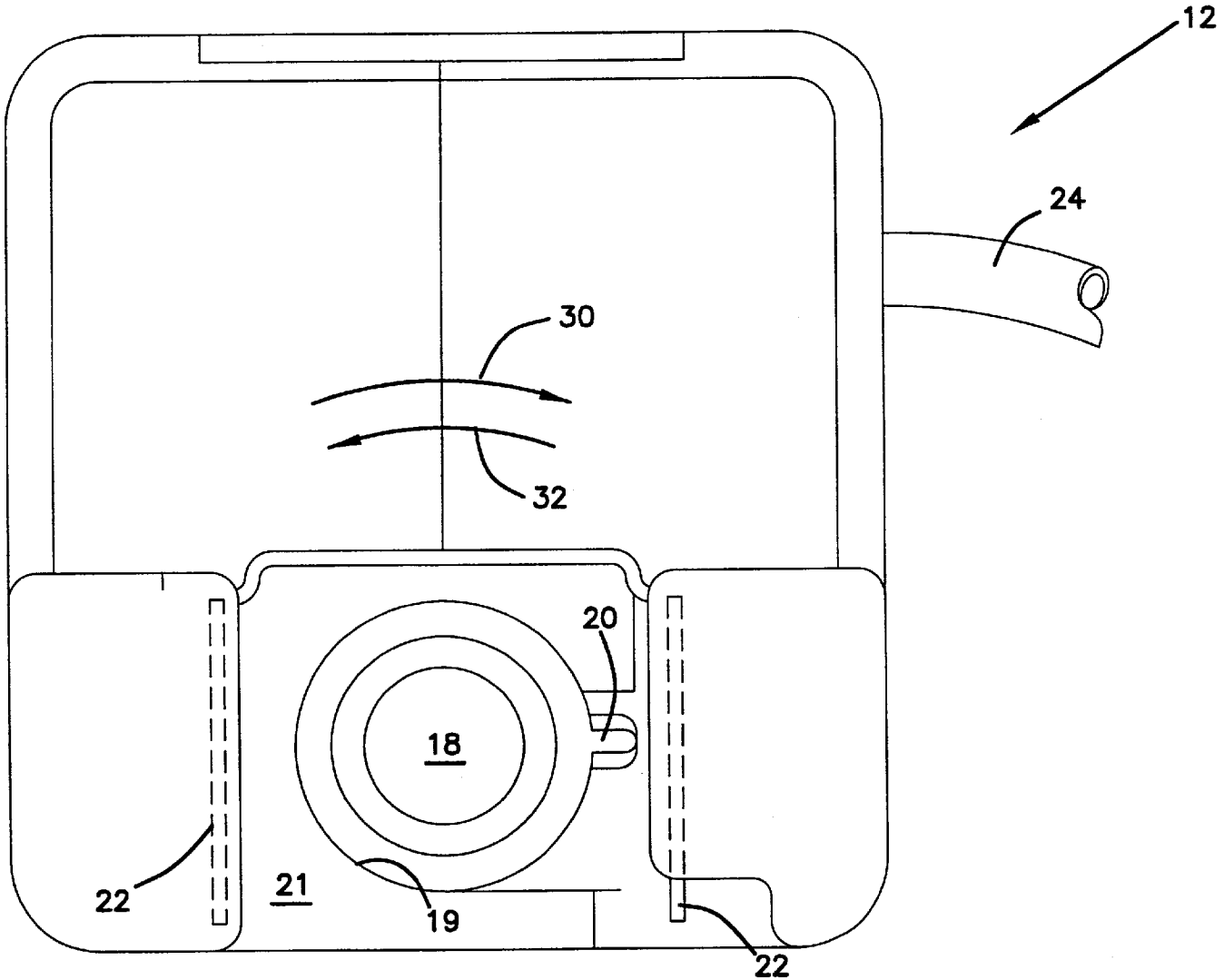
FIG. 2 PRIOR ART
FIG. 2 is a top view the dispenser assembly of FIG. 1, showing directional arrows for the movement of a bottle with a valve cap as will be described herein during use.

Referring now to FIGS. 1–11, there is shown a preferred embodiment of a fluid dispensing system including a fluid dispenser assembly 12 and a bottle 14 containing a quantity of a fluid that is to be dispensed. Typically, the fluid is provided in a concentrated form with the intention that the concentrate will be diluted with at least one other diluting fluid prior to being dispensed and used. The concentrate in bottle 14 may be any of a wide variety of material, such as cleaning fluids, solvents, disinfectants, insecticides, herbicides, or the like. The dilutant may be water or any other suitable fluid. Generally, dispenser assembly 12 is constructed in accordance with U.S. Pat. No. 5,425,404, the disclosure of which is incorporated by reference.

Bottle 14 of the present invention includes a valve cap 16 for controlling dispensing of concentrate from bottle 14. Bottle 14 with valve cap 16 cooperates with dispenser assembly 12 during use to dispense and dilute the concentrate. Specifically, bottle 14 is inverted as shown in FIGS. 3–11, and valve cap 16 is inserted into a chamber 18 of dispenser assembly 12. Chamber 18 has a generally cylindrically-shaped sidewall 19. Valve cap 16 generally includes a first valve part 40 (See FIG. 6) which mounts to a bottle body 60 of bottle 14 for rotation with bottle body 60 during use. Valve cap 16 also includes a second valve part 50 (FIG. 6) mounted to first valve part 40 for relative movement so as to open and close valve cap 16. During use of bottle 14 with dispenser assembly 12, a side projection or tab 52 on second valve part 50 resides in a notch 20 of dispenser assembly 12. To operate valve cap 16 between closed (FIG. 6) and open (FIG. 11) positions, bottle 14 is rotated, preferably by the user grasping bottle body 60 at end portion 417, and rotating bottle body 60 in the direction of arrow 30 (FIG. 2) to open valve cap 16. Rotation of bottle body 60 in the direction of arrow 32 (FIG. 2) returns valve cap 16 to the closed position. Notch 20 constrains second valve part 50 from rotating as first valve part 40 and bottle 14 are rotated by the user.

Rotation of bottle body 60 rotates first valve part 40 about a longitudinal axis 41 relative to second valve part 50 held from rotation by tab 52 positioned within notch 20 of dispenser assembly 12. Rotation of bottle body 60 also rotates a camming flange 42 extending from first valve part 40. Camming flange 42 selectively operates a dilutant valve 22 which controls the flow of dilutant from an inlet 24 to dispenser assembly 12 to enter a mixing chamber 26 of dispenser assembly 12. Dispenser assembly 12 includes two dilutant valves 22, each of which is linked to inlet 24 of dispenser assembly 12. Concentrate flows from within bottle 14 through valve cap 16 into mixing chamber 26 when second valve part 50 is moved relative to first valve part 40 thereby opening valve cap 16. Air from the atmosphere enters bottle 14 through valve cap 16 as concentrate is dispensed. The concentrate and the dilutant are mixed within mixing chamber 26 and exit dispenser assembly 12 together at an outlet 28. Bottle body 14 is rotated back in the opposite direction to close valve cap 16, and to release camming flange 42 from engagement with each dilutant valve 22. Each dilutant valve 22 is spring loaded such that each dilutant valve automatically closes when bottle 14 is rotated back to the closed position. It is to be appreciated that other dispenser assemblies are possible for use with bottle 14 where the dispenser assembly holds second valve part 50 during rotation of bottle body 60, first valve part 40, and camming flange 42.

Figure 11:
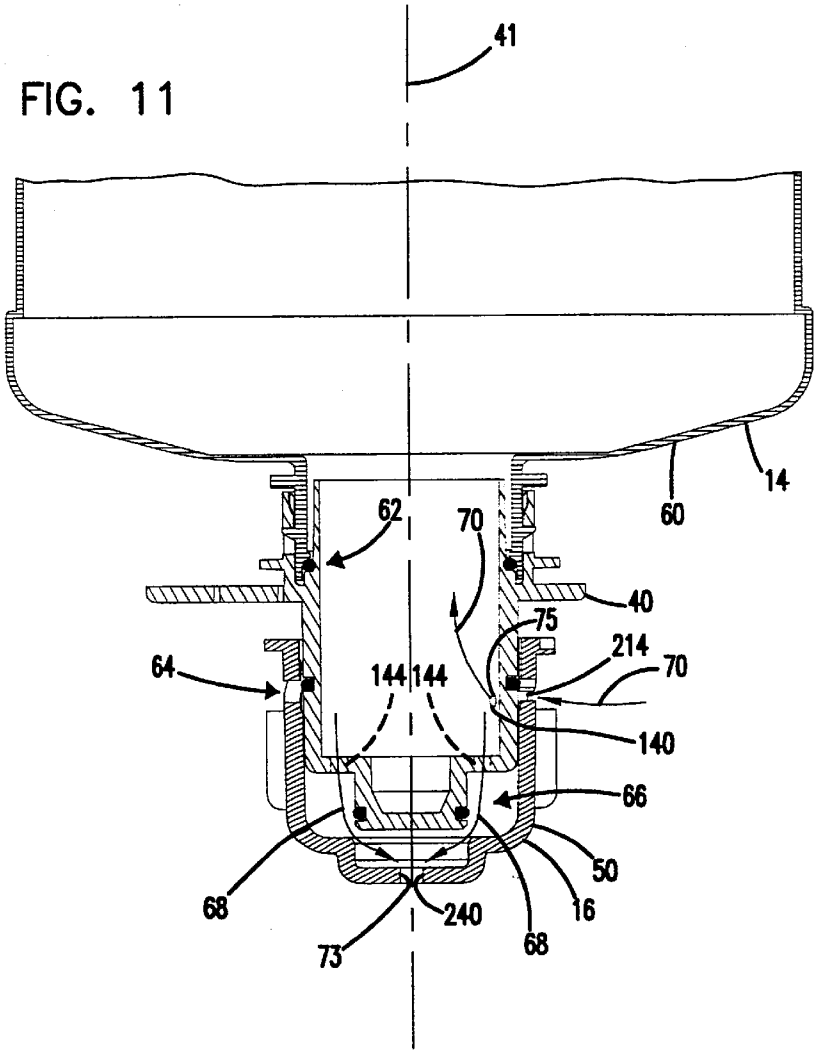
FIG. 11 is a cross-sectional view like FIG. 6, showing the valve cap in the open position.
Figure 6:
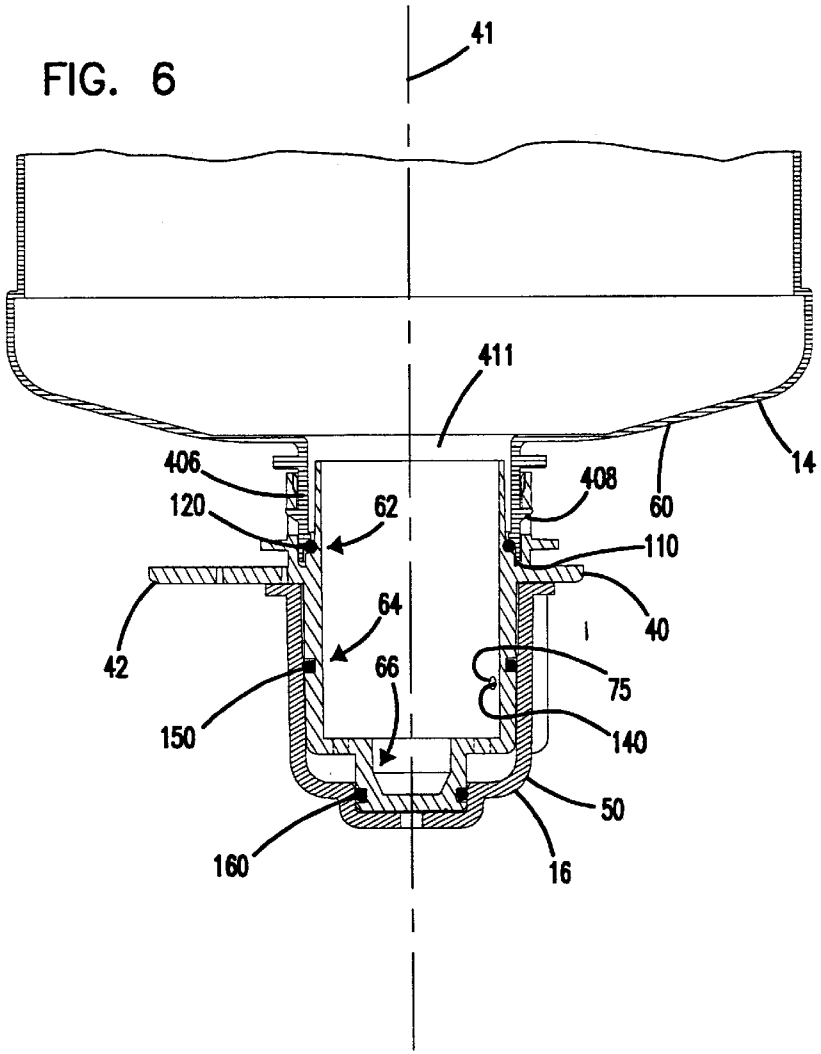
FIG. 6 is a cross-sectional side view through the valve cap and a portion of the bottle, showing the valve cap in the closed position.
Figure 9:
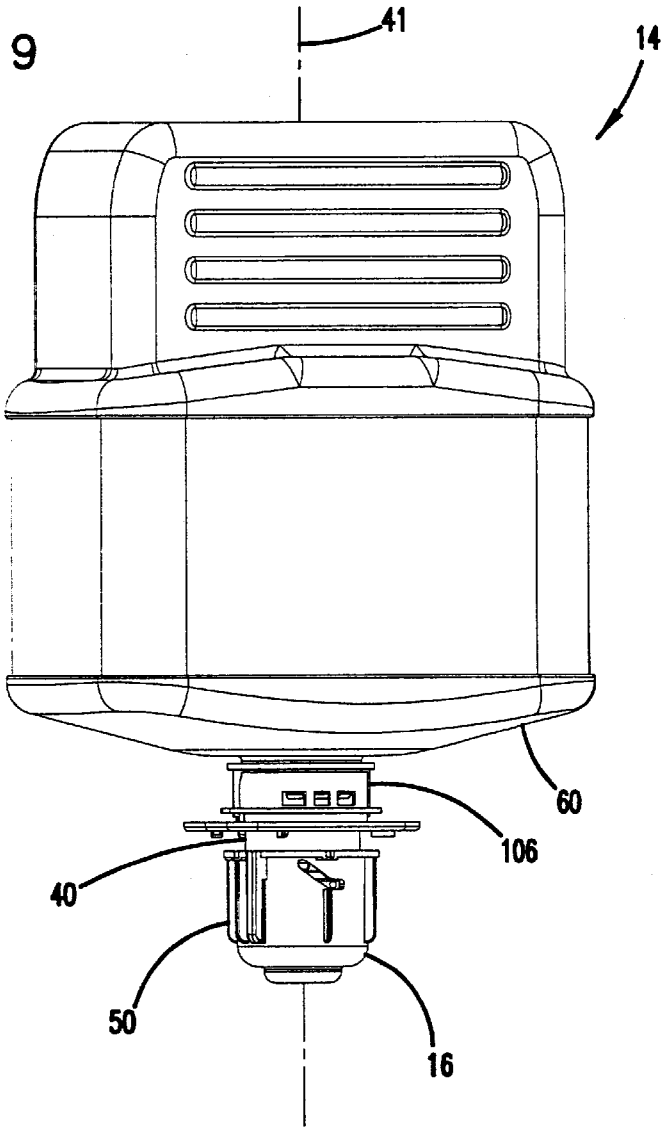
Figure 8:
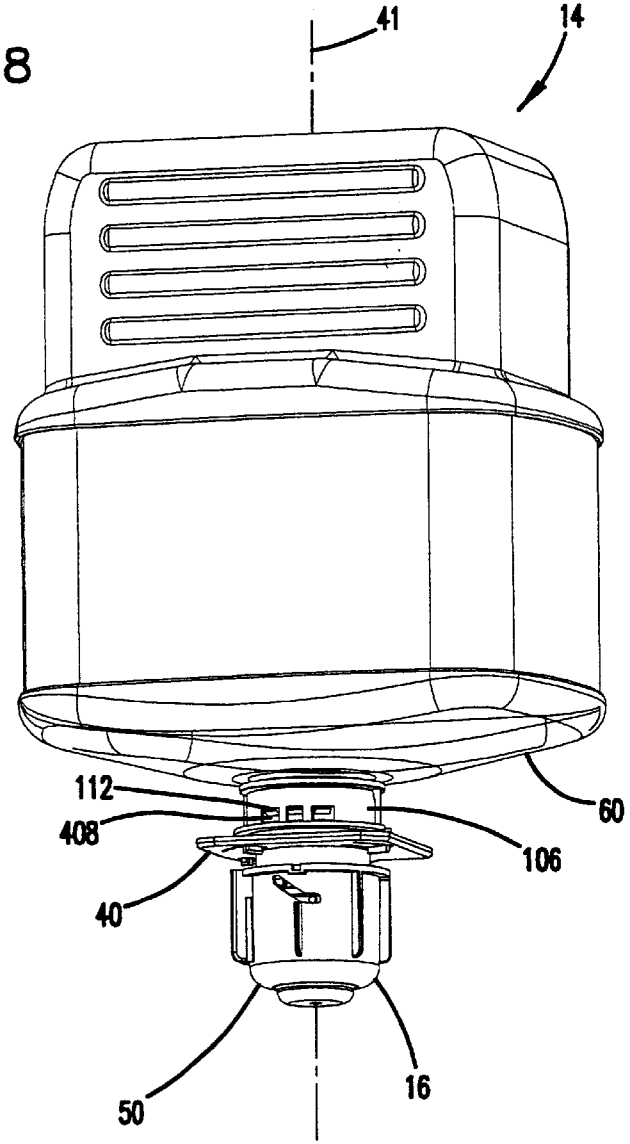
Figure 10:
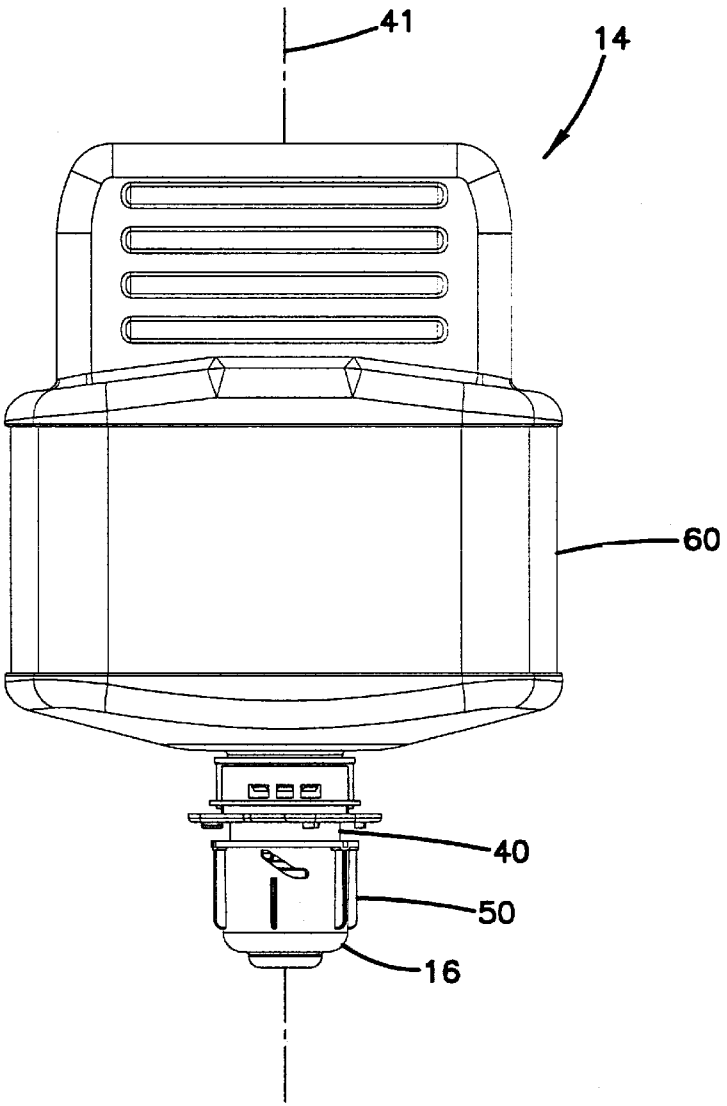

Referring now to FIGS. 6 and 11, valve cap 16 is shown both in the closed position (FIG. 6), and in the open position (FIG. 11). FIGS. 6 and 11 illustrate three seal regions 62, 64, and 66 for sealing an interior of bottle 14 at valve cap 16 from an exterior. Seal regions 64 and 66 are selectively opened to allow air and fluid to pass through valve cap 16 at the desired time, as shown in FIG. 11. Seal regions 62, 64, and 66 will be discussed in more detail below. FIG. 11 illustrates the fluid flow path out of bottle 14 represented by arrows 68 through a fluid outlet 73 of valve cap 16, and the airflow path into bottle 14 represented by arrows 70 through an air inlet 75 of valve cap 16. The fluid flow path and the airflow path will be discussed in more detail below. Generally, valve cap 16 allows fluid outflow under the effects of gravity, since fluid outlet 73 is disposed vertically below the air inlet 75. Air from the atmosphere enters bottle 14 at air inlet 75 as fluid is dispensed. Valve cap 16 may be referred to as a "constant head valve" since the fluid level within bottle 14 above air inlet 75 does not impact fluid outflow rate. Metering of fluid flow is accomplished by providing fluid outlet 73 with a predetermined size to allow for the desired flow rate of fluid from bottle 14.

Valve cap 16 in the preferred embodiment includes generally tubular-shaped and concentrically arranged components which rotate and longitudinally move between positions so as to open and close valve cap 16. The tubular portions are generally cylindrical in the preferred embodiment, although some angles and tapers may be provided to facilitate manufacture from molded materials. Steeper angles, or more conically-shaped components, are also possible wherein rotation and/or longitudinal movement of the two parts occurs with respect to a common axis, as in the preferred embodiment shown.

Tamper resistant features are also provided with valve cap 16 in the preferred embodiment. The tamper resistant features prevent undesired or inadvertent dispensing by locking second valve part 50 to first valve part 40 in the closed position. Preferably, the tamper resistant features are deactivated automatically upon use of bottle 14 and valve cap 16 with dispenser assembly 12.

Preferably, first valve part 40 and second valve part 50 snap together during assembly. Further, it is preferred that valve cap 16 snaps onto bottle 60 for further ease of assembly.

While the preferred embodiment includes both rotational and longitudinal relative movement of the valve components, it is to be appreciated that aspects of the invention are applicable to valve cap embodiments which rely only on rotational movement to open and close the valve, and also valve caps which rely only on longitudinal movement to open and close the valve.

Referring now to FIGS. 12–21, first valve part 40 includes an upper and 100, an opposite lower end 102, and a longitudinal central axis 104. Adjacent to upper end 100 of first valve part 40 is structure for mounting first valve part 40 to bottle body 60. First valve part 40 includes a tubular collar 106, and an upper tubular portion 108 inside of collar 106. Between collar 106 and tubular portion 108 is a space 110 for receiving a neck 406 of bottle body 60 (see FIG. 6). An O-ring 120 in space 110 further seals first valve part 40 to bottle body 60 at first seal region 62. Apertures 112 through collar 106 receive projections 408 of bottle body 60 (see also FIGS. 6, 8 and 29–34). Six apertures 112 and projections 106 are shown in the illustrated embodiment.

To facilitate alignment and attachment of first valve part 40 to bottle body 60 during assembly, a small notch 114 above each aperture 112 in collar 106 is provided for receipt of projections 408. When first valve part 40 is mounted to bottle body 60, a central orifice 410 of neck 406 of bottle body 60 is in fluid communication and air flow communication with first valve part 40. Additional projections 408 and apertures 112 are possible. Fewer projections 408 and apertures 112 are also possible, including just one of each.

Neck 406 of bottle includes two outwardly extending flanges 413 which are received in slots 118 in collar 106. A chamfer 119 directs flanges 413 into the narrow portion 122 of slots 118. Flanges 413 and slots 118 also facilitate alignment of valve cap 16 and bottle body 60.

To operate one or more dilutant valves 22 associated with dispenser assembly 12, first valve part 40 is provided with camming flange 42 including two camming lobes 126, 127 for engagement with each dilutant valve 22 upon rotation of camming flange 42 relative to dispenser assembly 12. A single lobe is also possible if desired to only operate one of dilutant valves 22.

Tamper resistant features are provided in connection with first valve part 40. Located on camming flange 42 are a plurality of locking tabs 128 including a flexible beam 130 and a longitudinally projecting finger 132. Each finger 132 is movable longitudinally for cooperation with notches on second valve part 50. A non-functional tab 134 is provided as an optional feature, so as to further deter tampering by confusing the user as to how many locking tabs there are. Stop ring 136 is provided to limit the amount of movement of each of locking tabs 128 during use. The tamper resistant features of first valve part 40 will be described in more detail below in connection with the discussion of second valve part 50.

First valve part 40 further includes a lower tubular portion 116 extending generally about longitudinal axis 104. Lower tubular portion 116 defines an air inlet opening or aperture 140 through the tubular wall portion 116. Aperture 140 forms air inlet 75 noted above for valve cap 16. A lower shoulder 142 on first valve part 40 defines at least one fluid opening or aperture 144. A plurality of apertures 144 are shown in the illustrated embodiment, spaced equally around the circular ring defining lower shoulder 142. If desired, metering can be controlled through apertures 144. A lower portion 146 of first valve part 40 further defines a fluid sealing region for valve cap 16. Specifically, lower portion 146 includes a circumferential recess 148 for holding an O-ring 160 which is used to selectively seal against second valve part 50. O-ring 160 can also be located adjacent end surface 152. O-ring 160 seals against second valve part 50 to form third seal region 66.

As will be further described below, outside surface 156 of tubular portion 116 selectively seals against second valve part 50 to control air flow into and out of valve cap 16 and bottle 14. In the preferred embodiment, a circumferential groove 158 in outside surface 156 receives an O-ring 150. O-ring 150 seals against second valve part 50 to form second seal region 64.

Outside surface 156 further includes projecting posts 164, for use in opening and closing valve cap 16, as will be described in greater detail below.

Referring now to FIGS. 22–28, second valve part 50 includes an upper end 200, an opposite lower end 202, and a longitudinal central axis 204. Tubular portion 206 supports projection 52 which is engaged by dispenser assembly 12 to hold second valve part 50 relative to dispenser assembly 12 while bottle 60 and first valve part 40 are rotated. An exterior surface 208 of tubular portion 206 further includes a plurality of spacers 210 which centrally space tubular portion 206 within chamber 18 of dispenser assembly 12. An interior surface 212 cooperates with O-ring 150, and lower interior surface 213 cooperates with O-ring 160 to seal valve cap 16 in the closed position. Extending between exterior surface 208 and interior surface 212 is aperture or opening 214. Two openings 214 are provided on opposite sides of tubular portion 206. One opening 214 aligns with air inlet aperture 140 to permit air flow communication from an exterior of valve cap 16 to an interior of valve cap 16 and into bottle 14 as shown in FIG. 11.

Each opening 214 is preferably configured as an angled camming slot with camming surfaces 216 which cooperate with projecting posts 164 of first valve part 240 to cause opening and closing of valve cap 16. Rotation of bottle 14 and first valve part 40 relative to second valve part 50 causes posts 164 to move along camming slot 216 so as to cause longitudinal movement between the first and second valve parts 40, 50. This results in alignment of air inlet aperture 140 with a portion of opening 214 of second valve part 50, allowing air flow into valve cap 16. Further, O-ring 160 of first valve part 40 separates from inner sealing surface 218 at lower end 202 of second valve part 50, allowing fluid flow out of valve cap 16. If desired, an O-ring can be mounted in a recess in end surface 242 to provide the fluid outlet seal with an end surface 152 of first valve part. End surface 242 includes an aperture or opening 240 which allows for fluid outlet. Opening 240 defines fluid outlet 73 noted above for valve cap 16. Opening 240 is centrally located in the preferred embodiment so as to allow fluid outflow into a central portion of dispenser assembly 12 for mixing with dilutant.

Opening 214 as a camming slot may be constructed so that the slot is longer than the range of motion of the first and second valve parts. This prevents bottoming out of posts 164, to help reduce stress on posts 164 as might occur during use, if posts 164 were allowed to engage an end of the slot. Engagement of other structure in the dispensing system, such as camming flange 42 and dispenser assembly 12 can be used to limit the range of motion of the valve parts.

Adjacent to upper end 200 of second valve part 50, a rim 230 is provided including three notches 232 for receipt of projecting fingers 132 of locking tabs 128 of first valve part 40. A fourth locking notch 234 is provided adjacent to non-functional tab 134 in the closed position, so as to give the appearance that a fourth locking tab needs deactivation if a user attempted to open valve cap 16 without dispenser assembly 12.

Upper end 200 of second valve part further includes inner assembly notches 250 so as to align with posts 164 during snap fit assembly of first and second valve parts 40, 50. Assembly notches 250 direct posts 164 longitudinally until they are received in their respective openings 214. Posts 164 include a tapered outer surface 166 to fit into notches 250 to help facilitate ease of assembly. Posts 164 in the illustrated preferred embodiment have a non-cylindrical side surface 168 (see FIG. 16). The lemon or oval shape provides increased load bearing surfaces with camming slots 216.

Figure 11A:
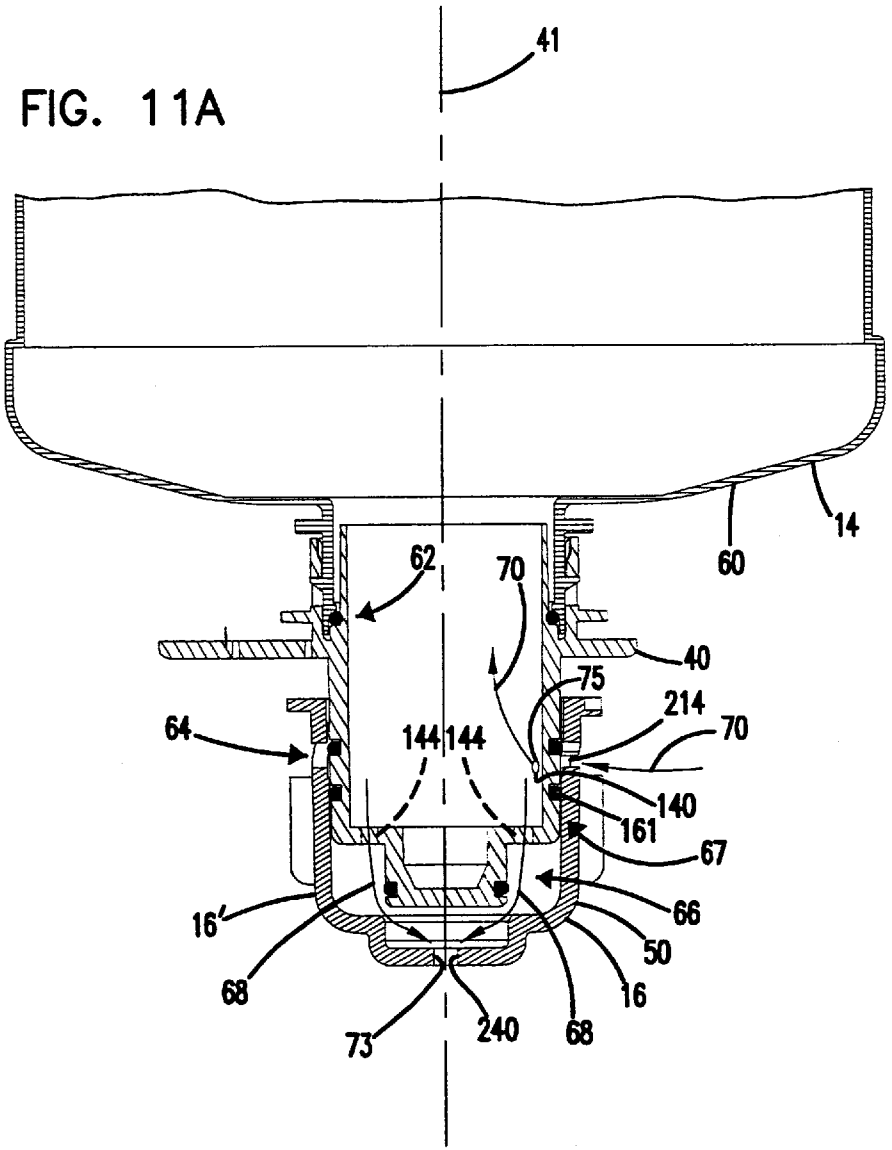
FIG. 11A is a cross-sectional view like FIG. 11, showing an alternative embodiment of the valve cap.
Figure 13:
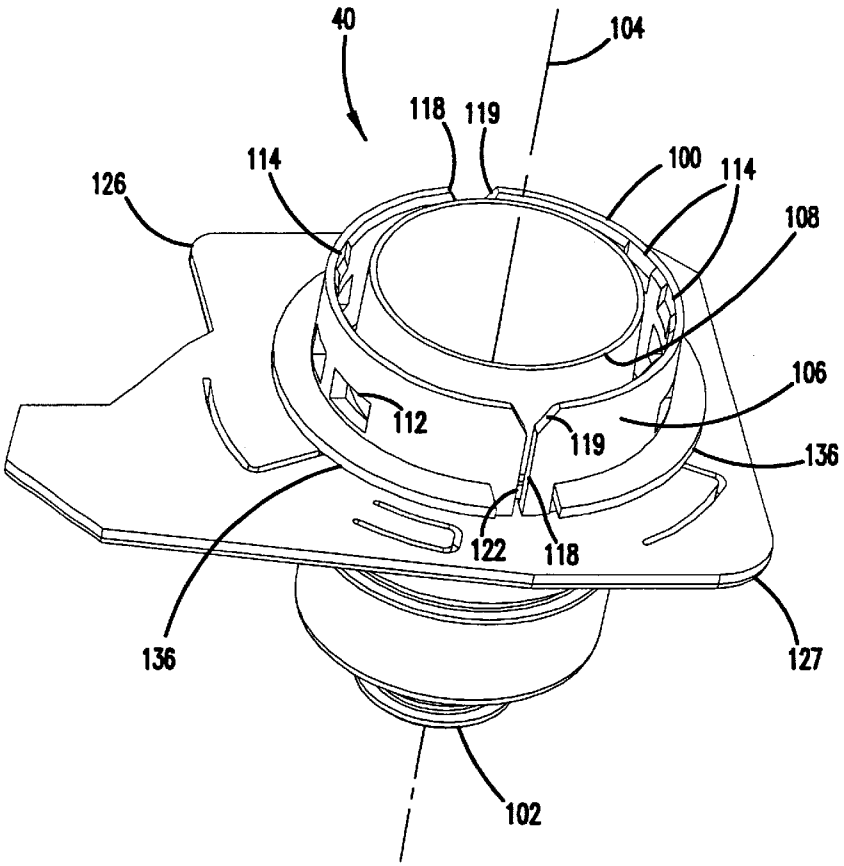
FIG. 13 is a top perspective view of the first valve part of FIG. 12.
Figure 12:
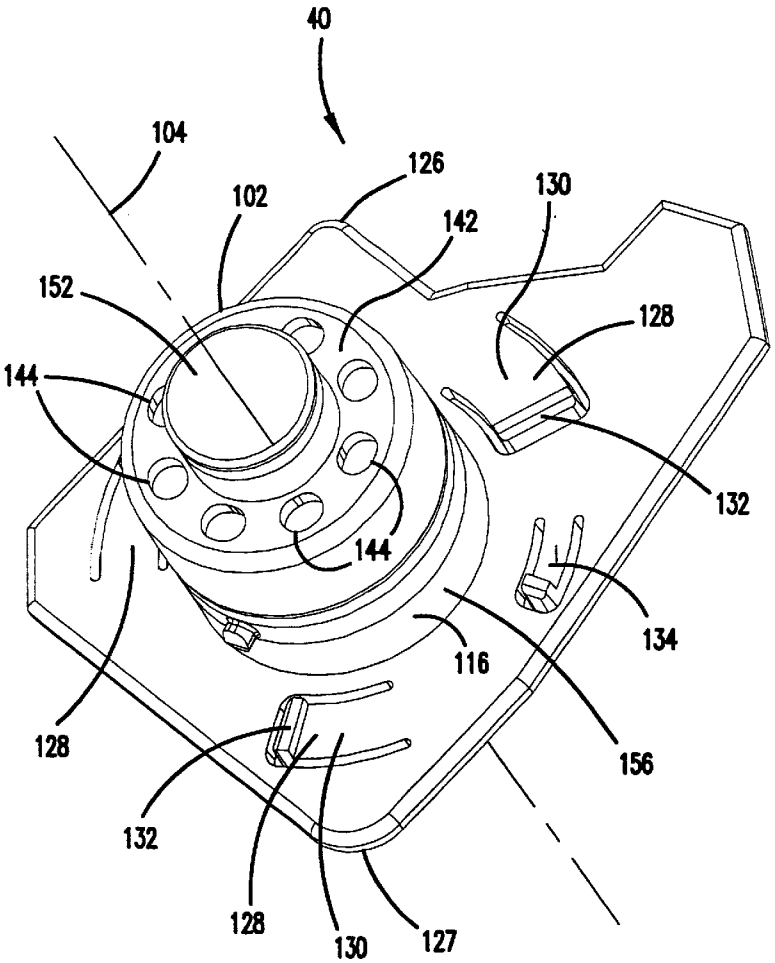
FIG. 12 is a bottom perspective view of a first valve part of the valve cap of FIG. 3.
Figure 15:
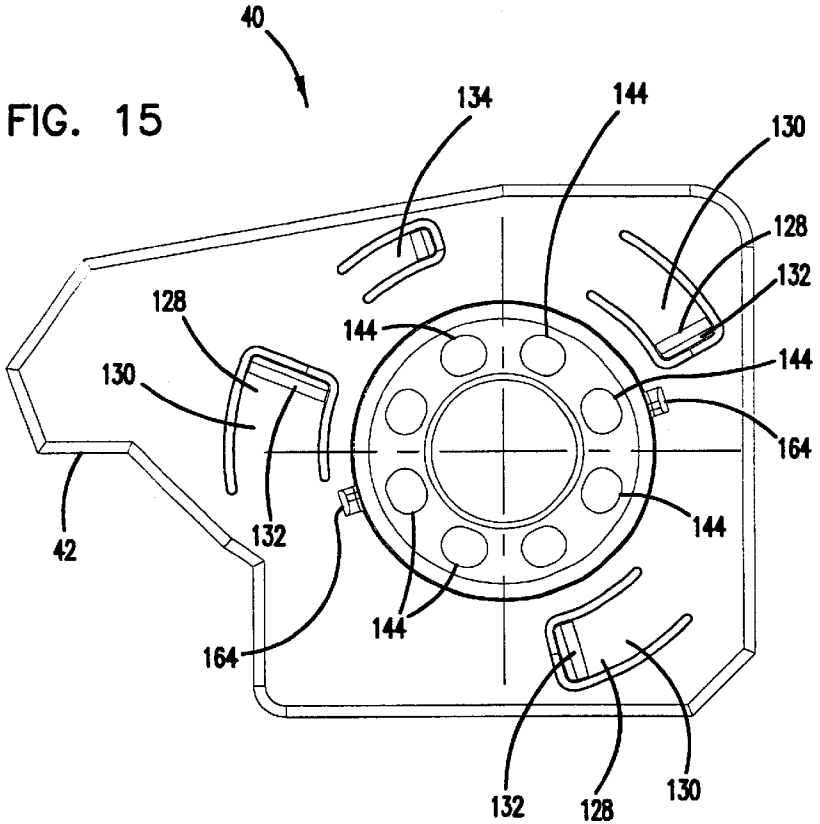
FIG. 15 is a bottom view of the first valve part of FIG. 12.
Figure 14:
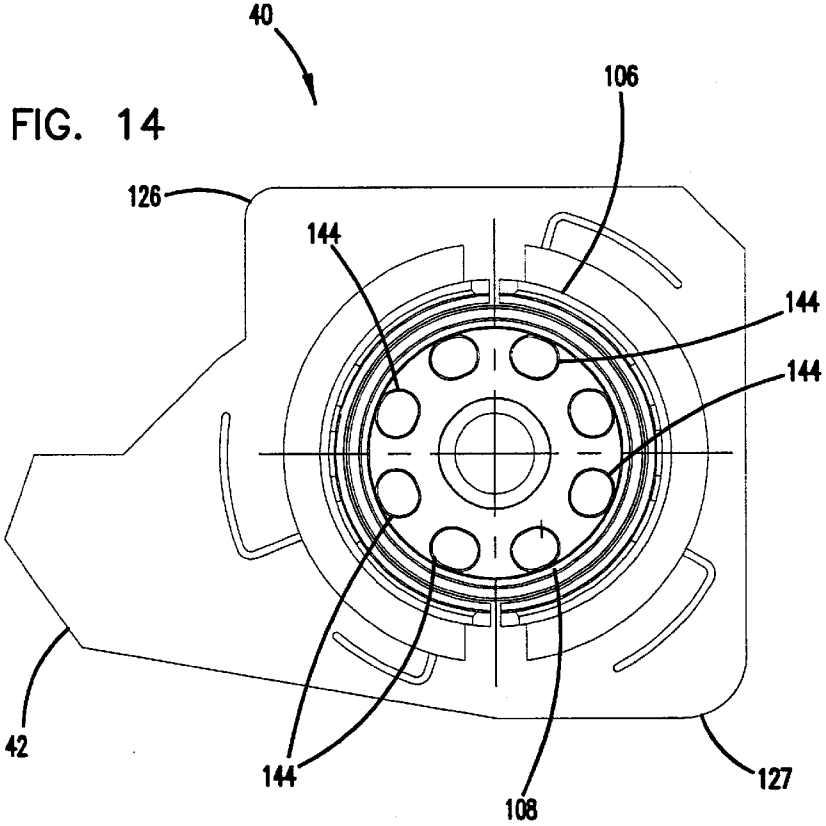
FIG. 14 is a top view of the first valve part of FIG. 12.
Figure 17:
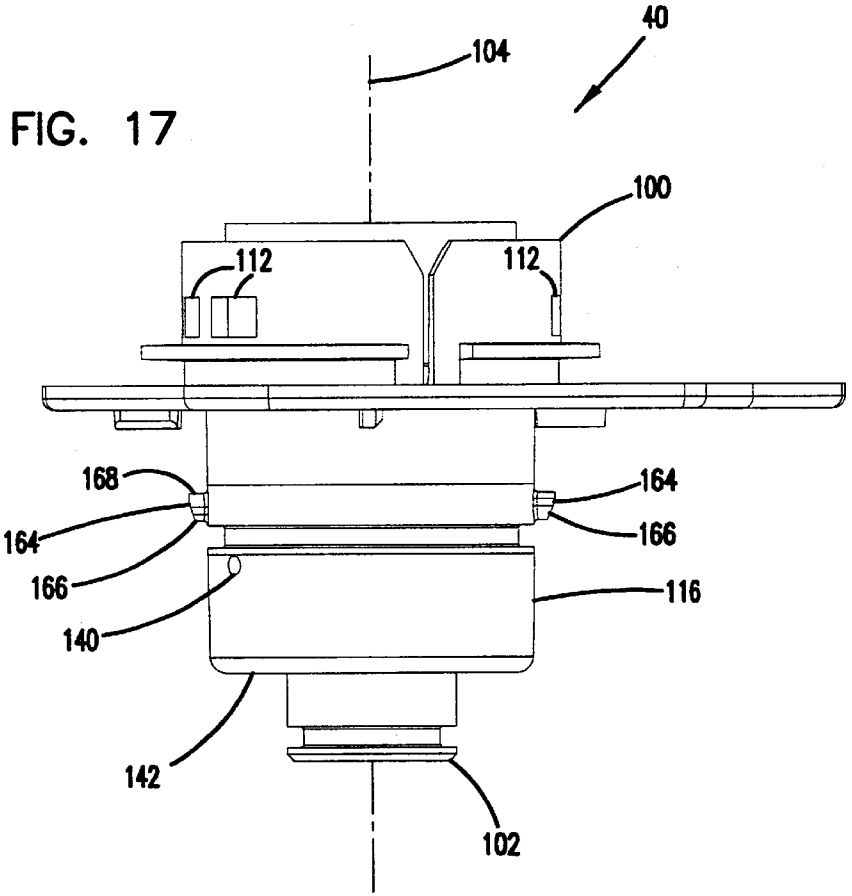
FIG. 17 is a further side view of the first valve part of FIG. 12.
Figure 16:
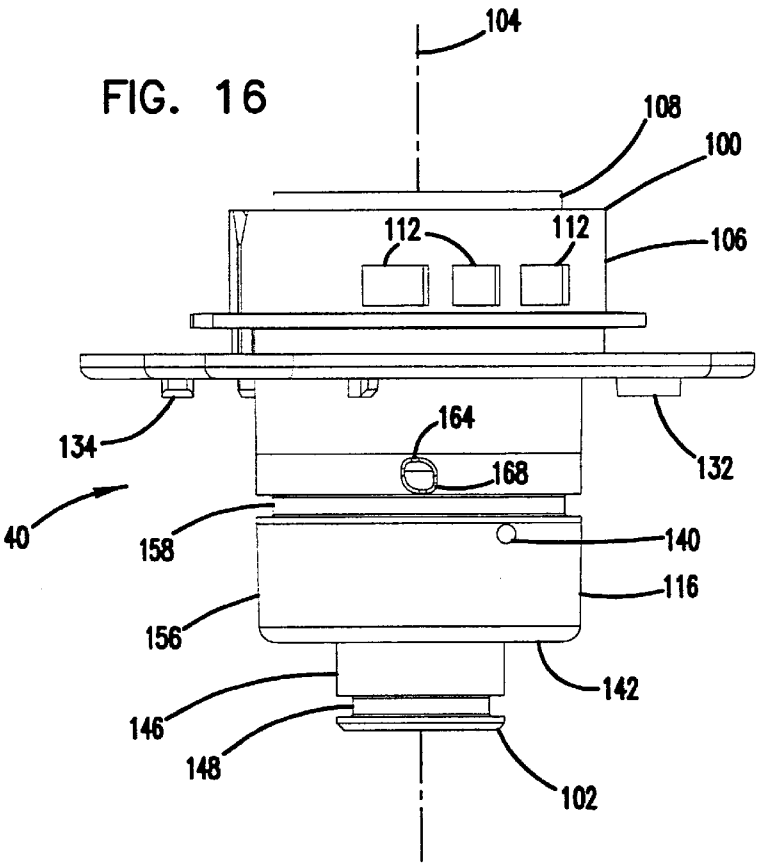
FIG. 16 is a side view of the first valve part of FIG. 12.
Figure 19:
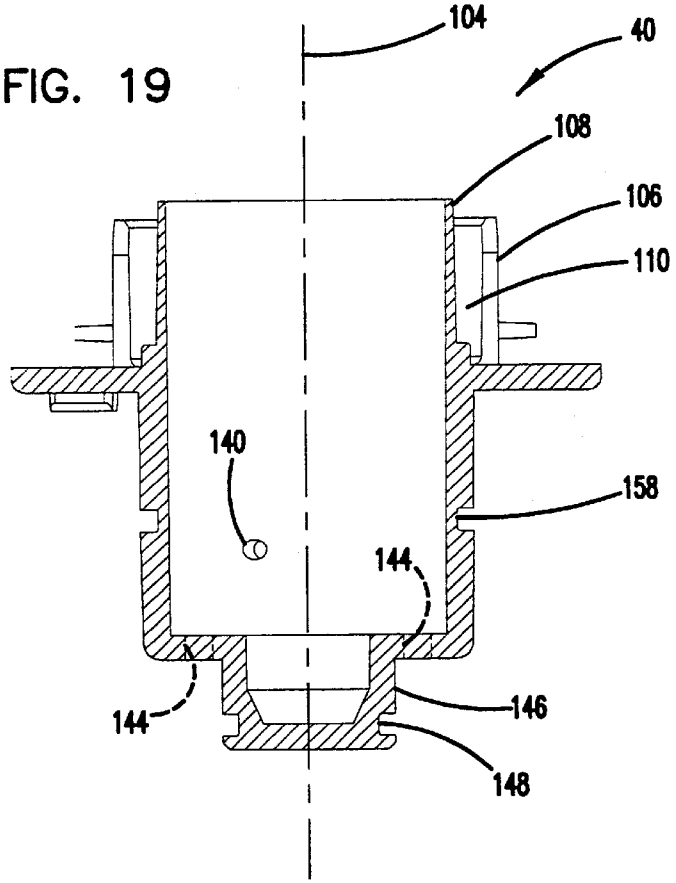
FIG. 19 is a cross-sectional side view of the first valve part taken along lines 19—19 of FIG. 18.
Figure 18:
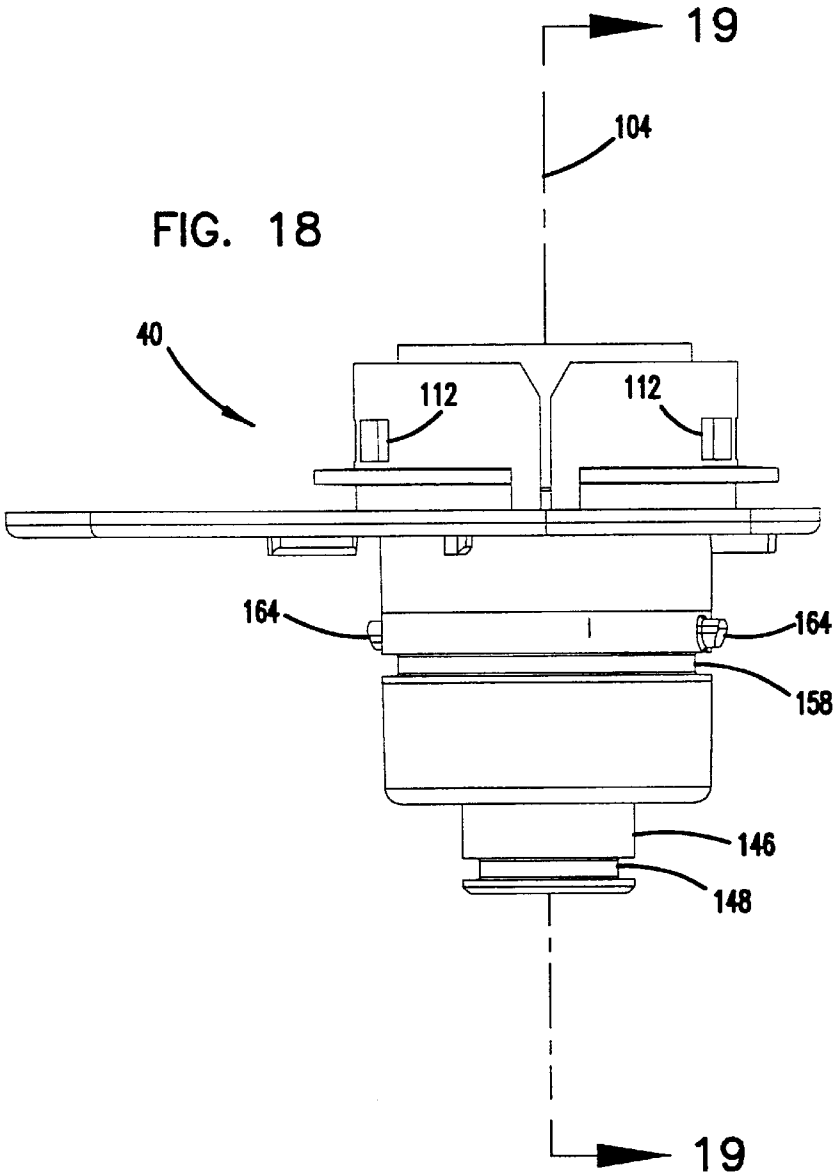
FIG. 18 is a further side view of the valve of FIG. 12.
Figure 21:
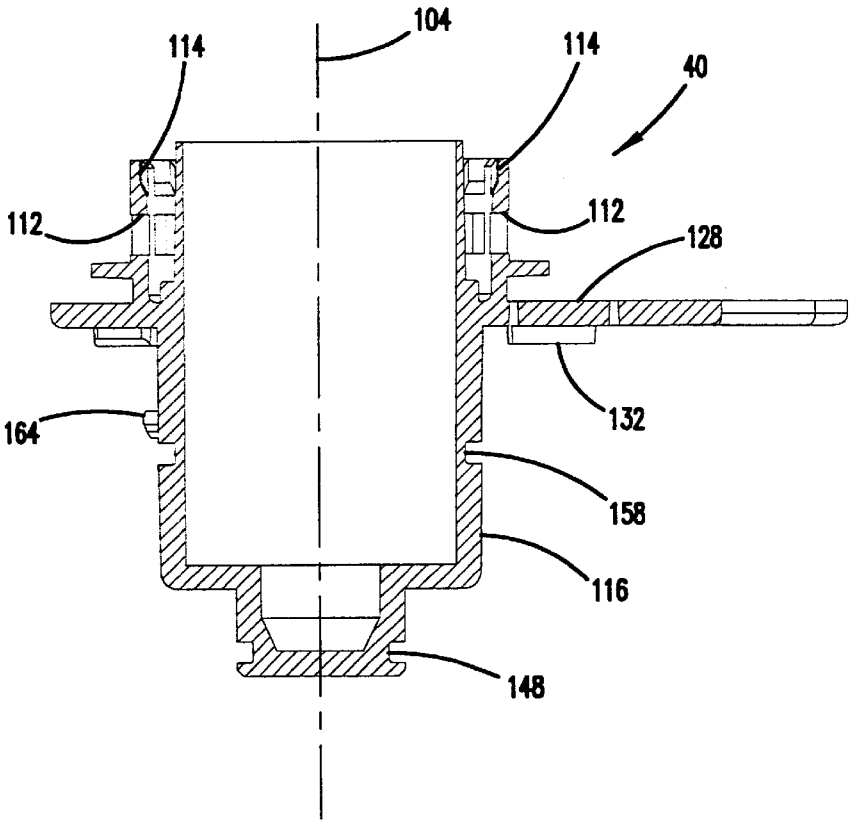
FIG. 21 is a cross-sectional side view of the first valve part of FIG. 20, taken along lines 21—21 of FIG. 20.
Figure 20:
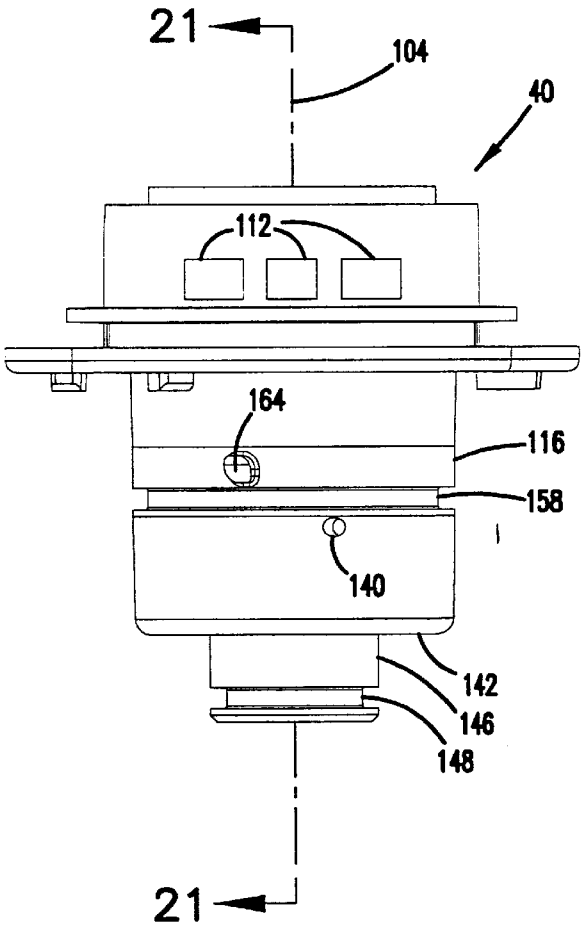
FIG. 20 is a further side view of the valve of FIG. 12.
Figure 24:
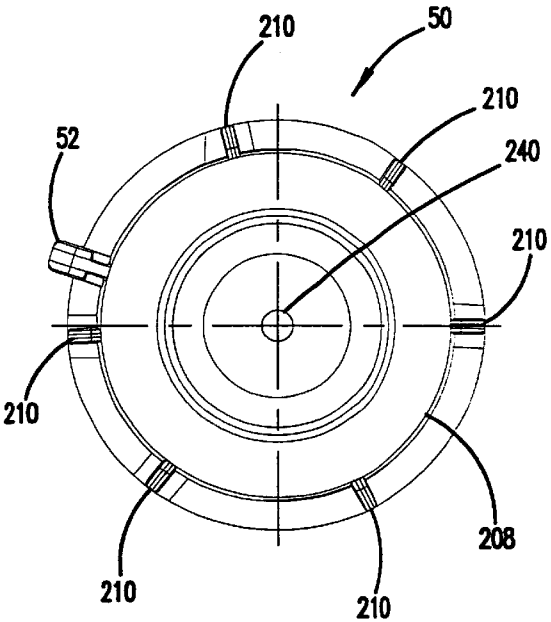
FIG. 24 is a bottom view of the second valve part of FIG. 22.
Figure 22:
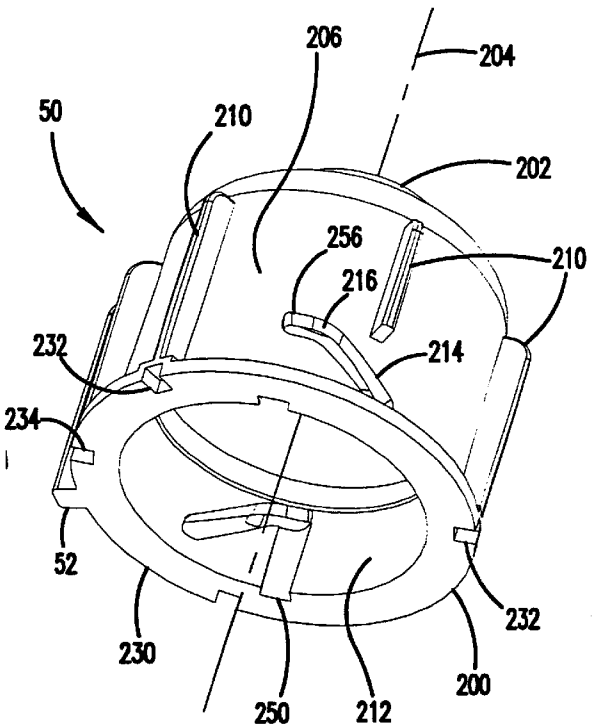
FIG. 22 is a top perspective view of the second valve part of the valve cap of FIG. 3.
Figure 23:
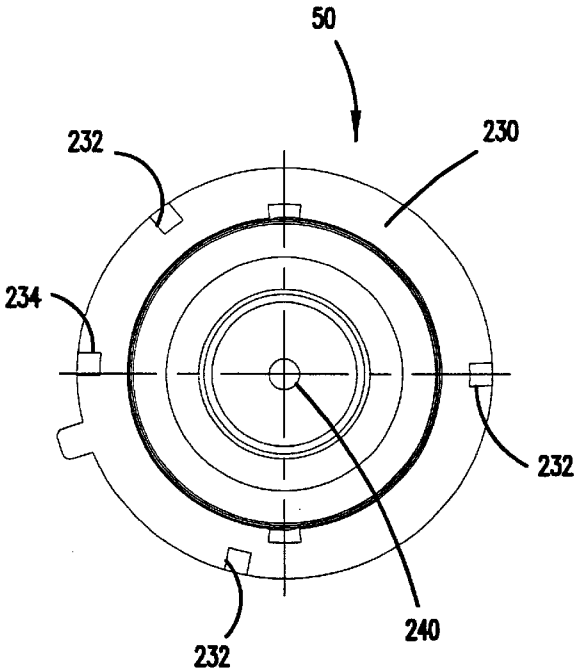
FIG. 23 is a top view of the second valve part of FIG. 22.
Figure 26:
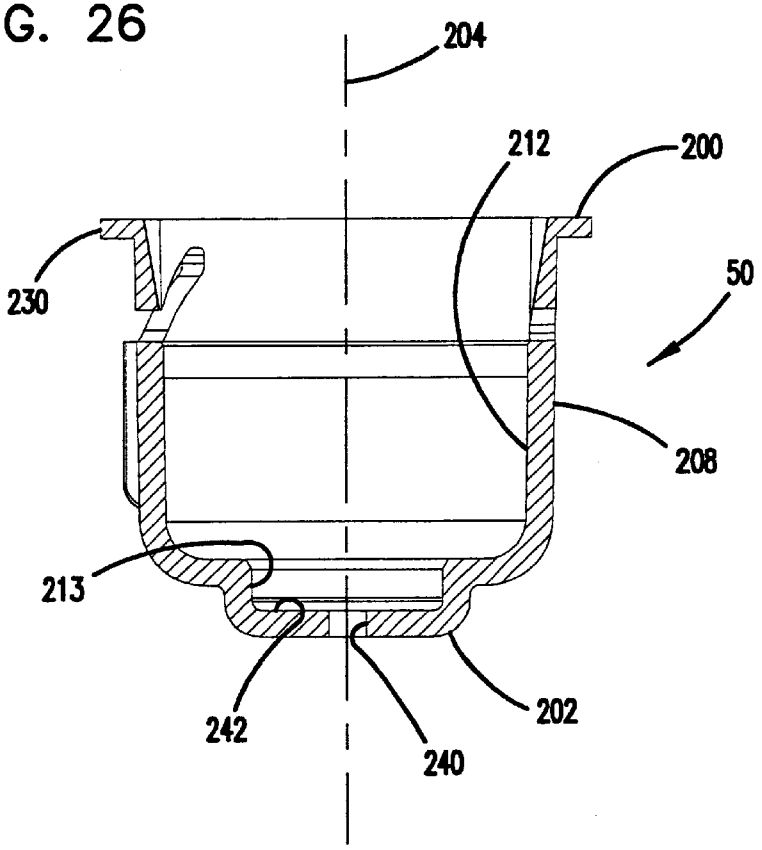
FIG. 26 is a cross-sectional side view of the second valve part taken along lines 26—26 of FIG. 25.
Figure 25:
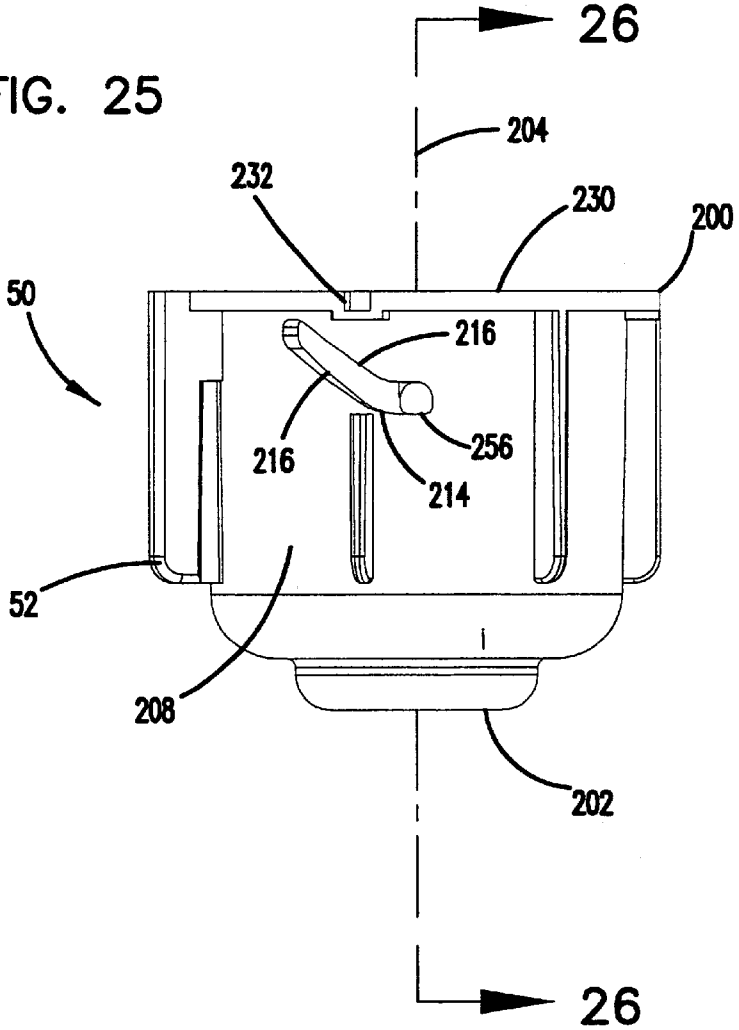
FIG. 25 is a side view of the second valve part of FIG. 22.
Figure 28:
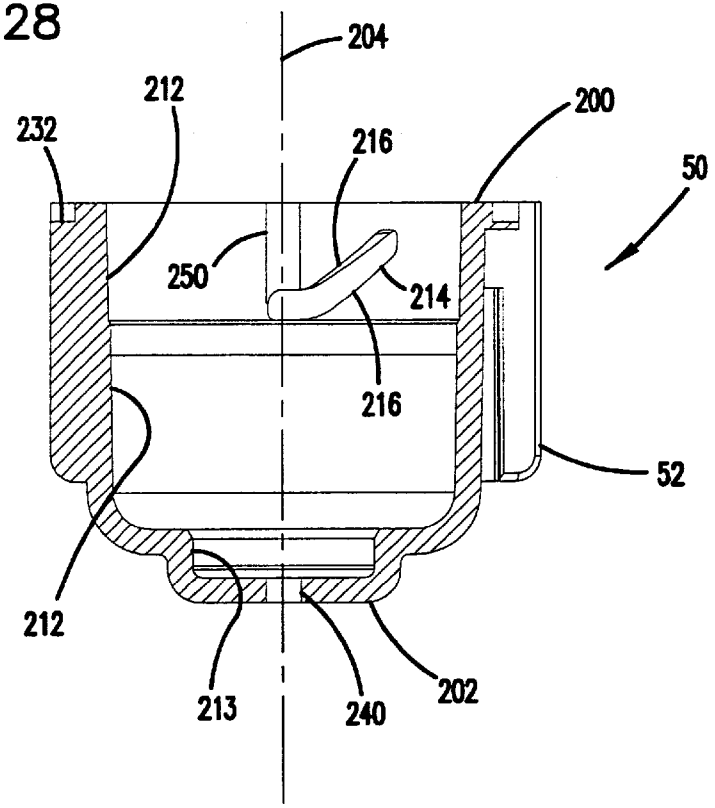
FIG. 28 is a cross-sectional side view taken along lines 28—28 of FIG. 27.
Figure 27:
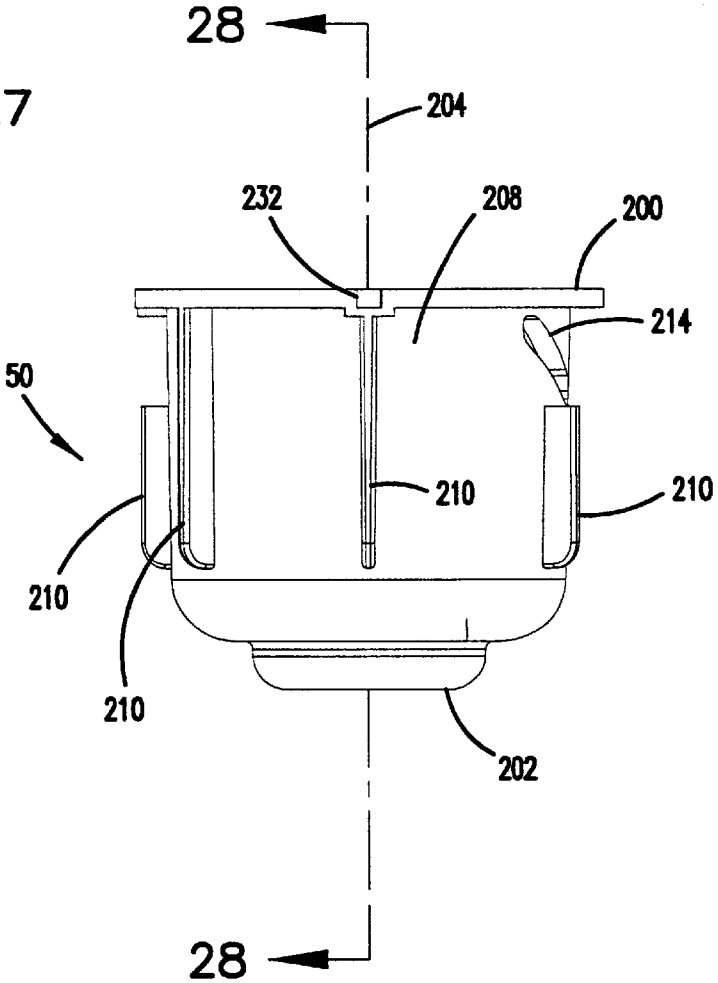
FIG. 27 is a further side view of the second valve part of the valve cap of FIG. 22.
Figure 29:
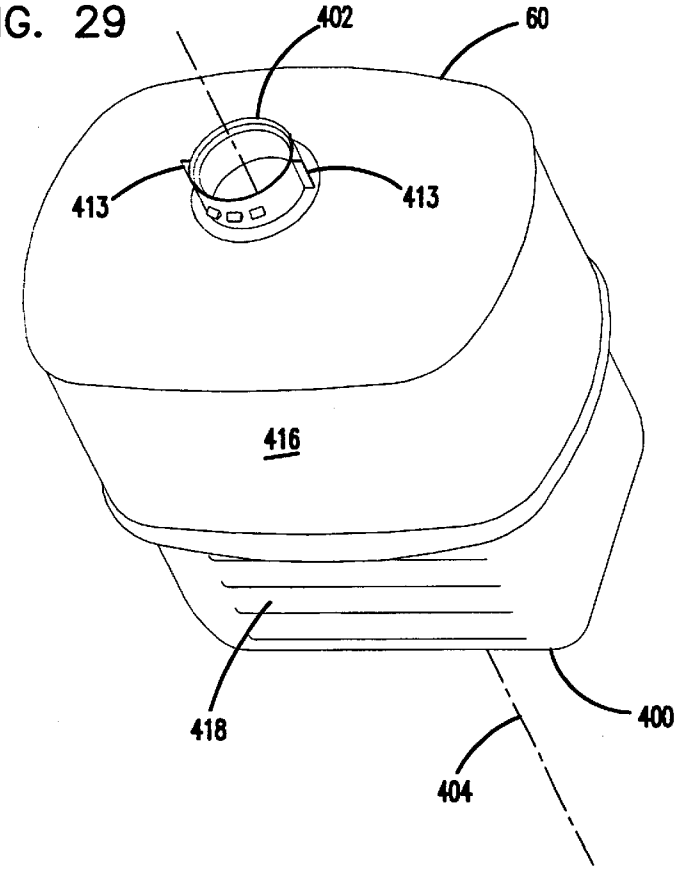
FIG. 29 is a perspective view of the bottle of FIG. 3.
Figure 33:
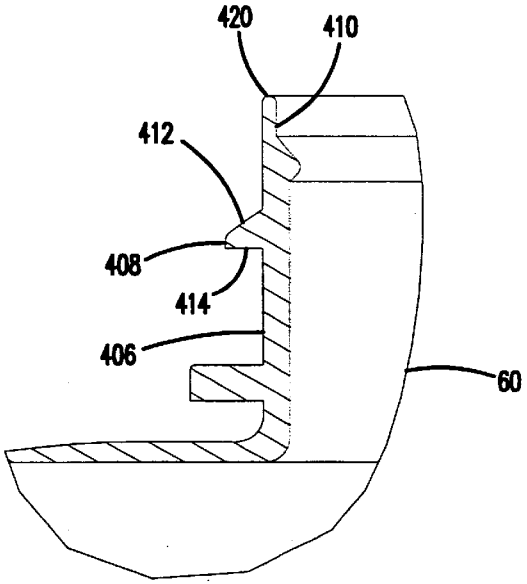
FIG. 33 is an enlarged view of a portion of the cross-section of the bottle at the neck.
Figure 30:
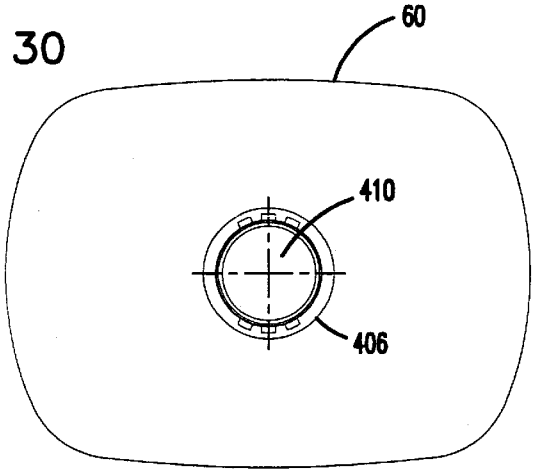
FIG. 30 is a bottom view of the bottle of FIG. 29.
Figure 34:
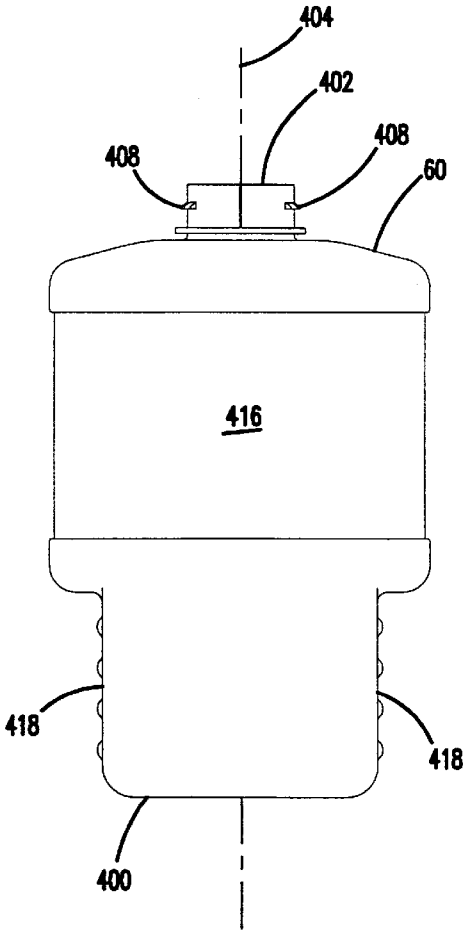
FIG. 34 is a further side view of the bottle of FIG. 29.
Figure 31:
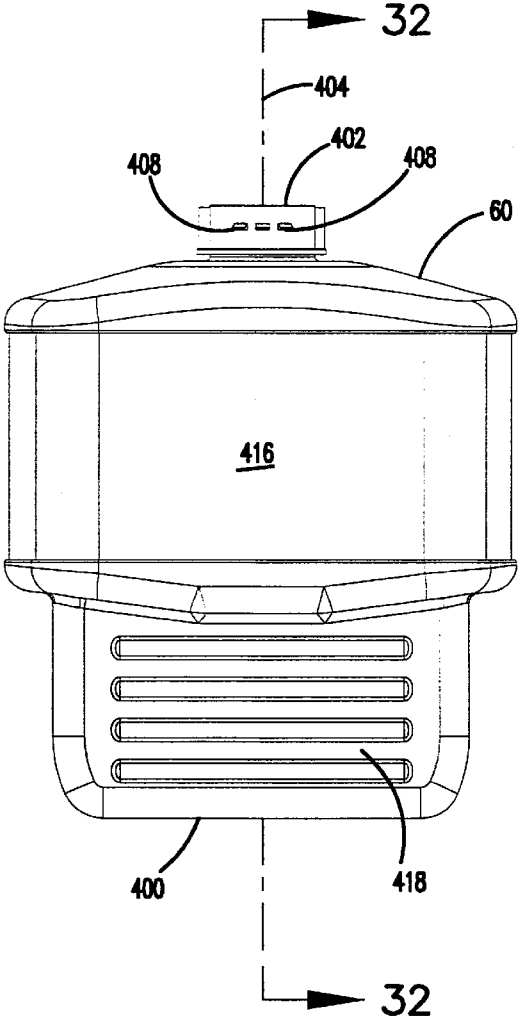
FIG. 31 is a side view of the bottle of FIG. 29.
Figure 32:
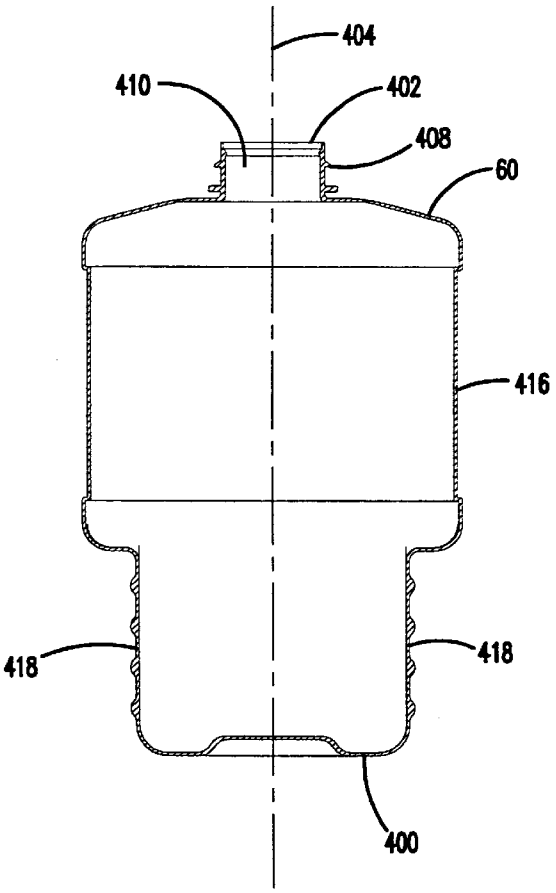
FIG. 32 is a cross-sectional side view of the bottle taken along lines 32—32 of FIG. 31.

Referring now to FIG. 11A, an alternative valve cap 16' is shown including an optional fourth seal region 67. Seal region 67 includes an O-ring 161 mounted in a recess like recess 158. O-ring 161 is provided for additional sealing of fluid from possibly migrating toward opening 214 in second valve part 50, instead of all the fluid exiting valve cap 16 at fluid outlet 73.

Referring back to FIG. 3, the tamper resistant features are illustrated in the locked position. When valve cap 16 is in the locked position, each locking tab 128 is positioned in a locking notch 232 of second valve part 50. When bottle 14 is operatively positioned in dispenser assembly 12, each locking tab 128 is moved or bent longitudinally upwardly due to a downward force applied by the user to bottle 14. Locking tabs 128 engage top surface 21 of dispenser assembly 12 so as to disengage from notches 232. In this condition, locking tabs 128 are no longer effective in limiting the ability of first valve part 40 and second valve part 50 to be rotated relative to one another. To prevent immediate lift off and longitudinal movement between first and second valve parts 40, 50 which could make it difficult for the user to apply sufficient force to allow tabs 128 to clear notches 232, camming slot 216 is configured with a slight circumferential slot portion 256 at the lowermost end which does not cause longitudinal separation of first and second valve parts 40, 50. (See FIGS. 22 and 25). By positioning a plurality of locking tabs 128 around valve cap 16, a user trying to bypass using dispenser assembly will have an impossible or difficult time moving by hand all of tabs 128 longitudinally at the same time to allow for second valve part 50 to be rotated relative to first valve part 40. While a plurality of locking tabs 128 and notches 232 are shown, more or less, including one of each can be provided to provide valve cap 16 tamper resistant. Further, providing the non-functional tab 134 and non-functional notch 234, a user may be deterred from even attempting to bypass dispenser assembly 12. Also, multiple fingers 132 can be provided on each tab 128.

With the above-noted tamper resistant system, valve cap 16 can only likely be opened if bottle 14 is operatively engaged with dispenser assembly 12. This would prevent a user from opening the bottle separate from dispenser assembly 12, and squeezing out the contents of bottle 14, possibly over dispensing the concentrate from bottle 14. Over dispensing can be wasteful, and it can also create a more hazardous mixture having too much concentrate present. The tamper resistant features are also effective in preventing inadvertent dispensing such that bottle 14 will remain in the locked and closed state until the user positions bottle 14 in dispenser assembly 12, and applies downward pressure while rotating the bottle so as to open valve cap 16 to begin dispensing of the concentrate through dispenser assembly 12. Such features are useful during storage and transport.

Figure 7:
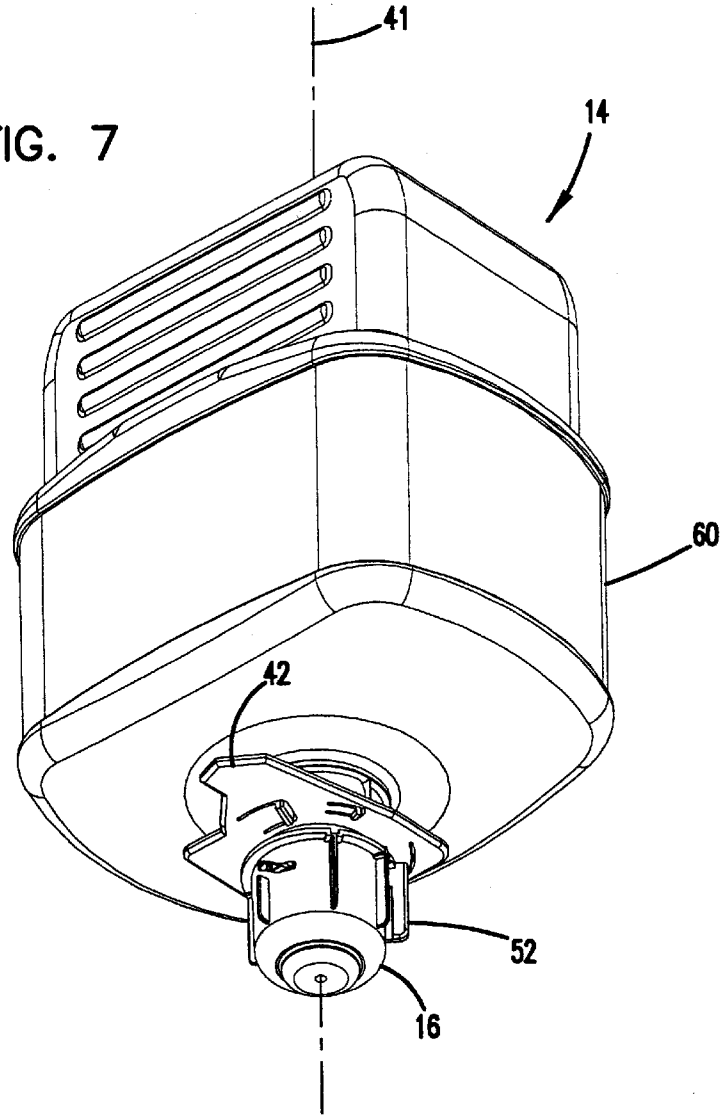
FIGS. 7–10 show the bottle and valve cap of FIGS. 3–5 in the open position.
Figure 3:
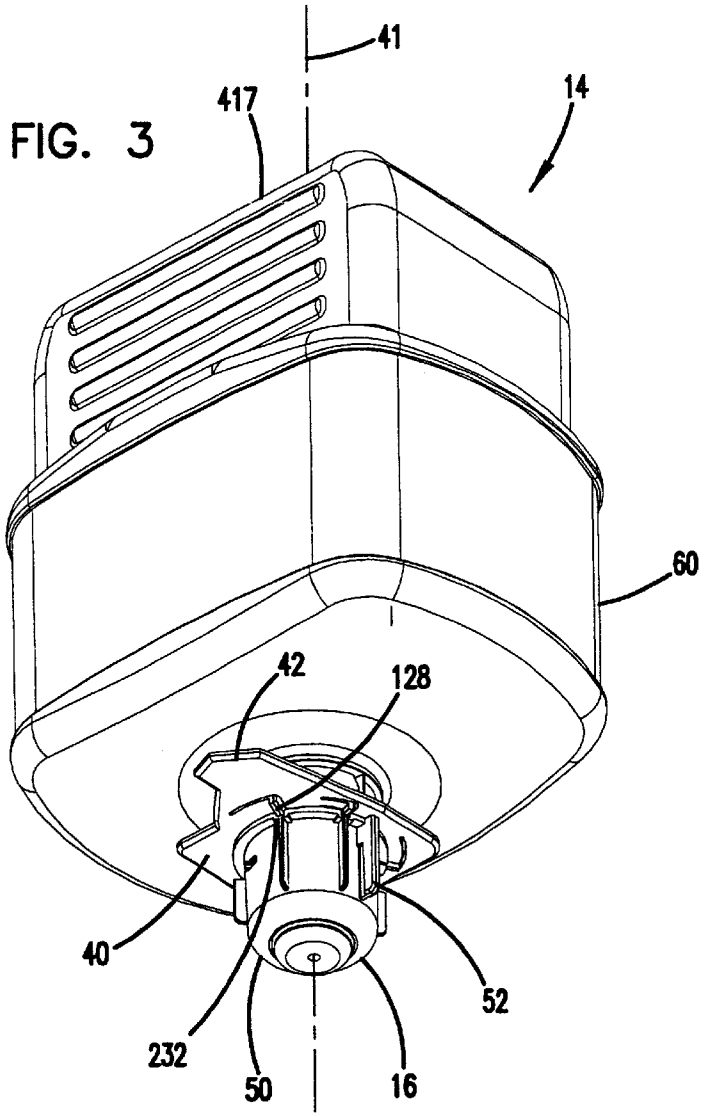
FIGS. 3–5 are various views of a preferred embodiment of a bottle with a valve cap according to the present invention, with the valve cap in the closed position.
Figure 5:
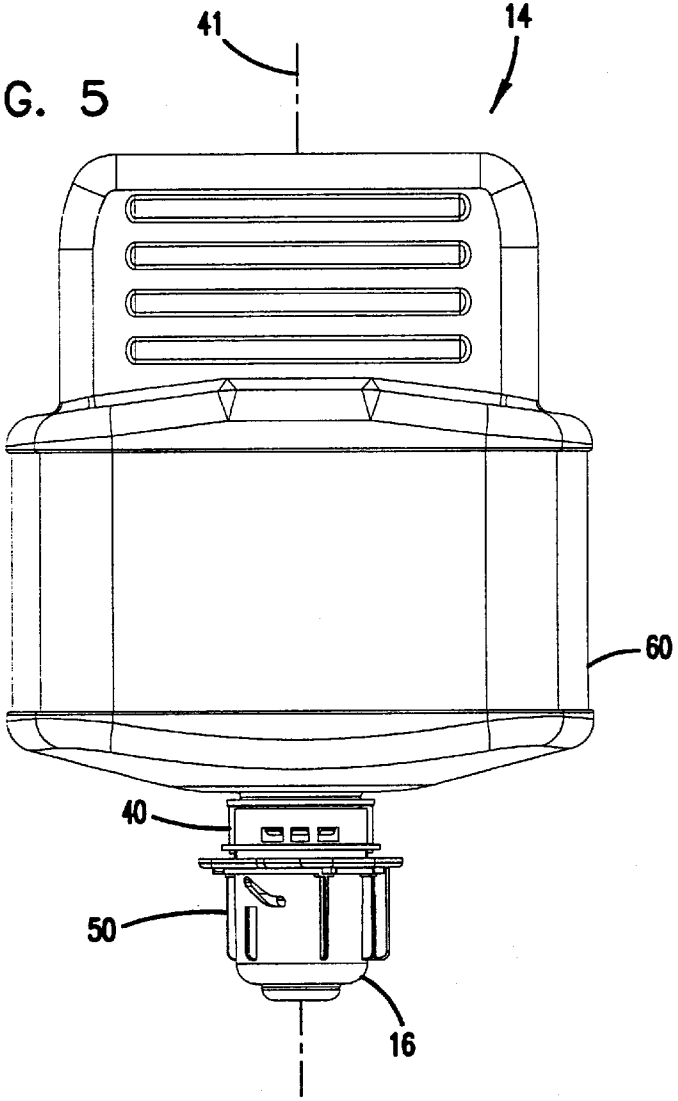
Figure 4:
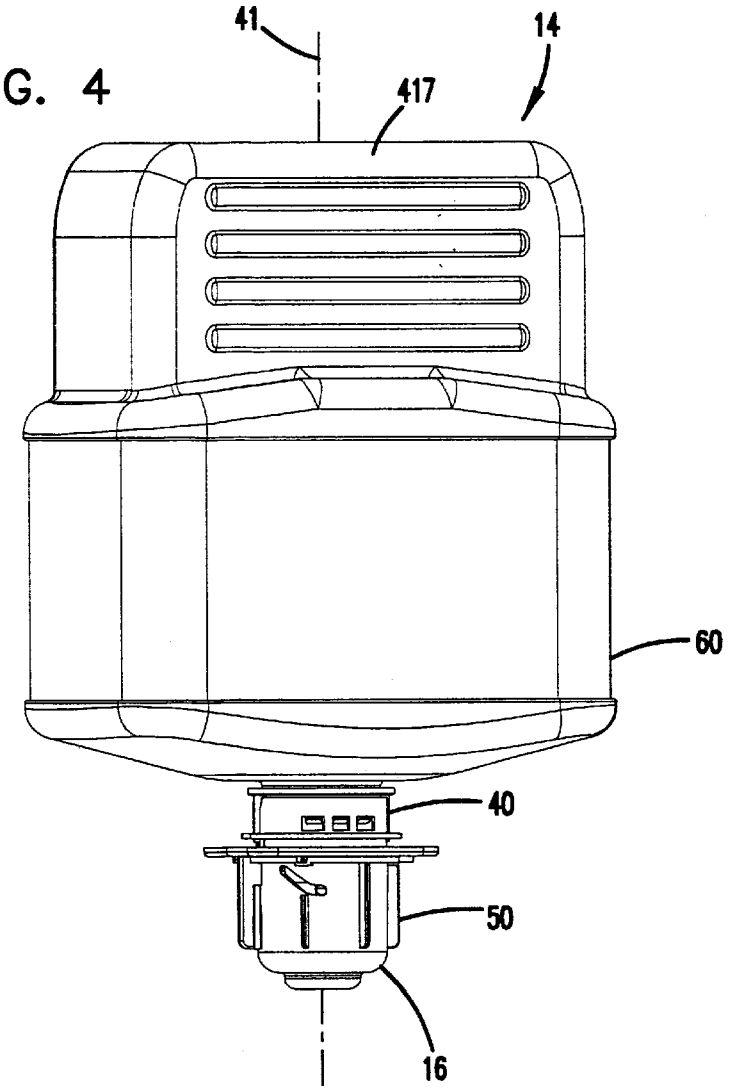

Referring now to FIGS. 29–34, bottle body 60 is shown including an upper closed end 400, a lower open end 402, and a longitudinal central axis 404. Adjacent to lower open end 402 is bottle neck 406 and orifice 410. Bottle body 60 snaps to valve cap 16 during assembly in the preferred embodiment. The plurality of projections 408 permit snap mounting of bottle body 60 to valve cap 16. Each projection 408 includes a ramp surface 412, and a stop shoulder 414 for engaging an inside surface of collar 106 of first valve part 40. Neck 406 is shown as including unequally spaced projections 408, so as to permit a limited number of ways of mounting valve cap 16 on bottle 60. First valve part 40 includes the unequally spaced apertures 112 for receipt of the unequally spaced projections 408. The flanges 413 and slots 118 in combination with the projections 408 and notches 114 results in camming flange 42 of valve cap 16 being in the proper position, and a predetermined portion of bottle body 60 facing the user during operation. Generally, body 60 includes a central region 416 suitable for receipt of a product label. Adjacent to upper closed end 400 are opposed gripping panels 418 for gripping by the hand as shown in FIGS. 3 and 7. In end surface 420 of orifice 410 seals against O-ring 120 to form bottle and valve cap fluid tight seal 62. Bottle body 60 is preferably made from molded plastic, such as high density polyethylene or other moldable plastic.

The construction of bottle 14, with valve cap 16, allows bottle 14 to be used with prior art dispenser assemblies 12 like those disclosed in U.S. Pat. No. 5,425,404 and shown in FIGS. 1 and 2, or other dispenser assemblies configured to engage valve cap 16 during use.

The above specification, examples and data provide a complete description of the manufacture and use of the invention. Many embodiments of the invention can be made without departing from the spirit and scope of the invention, the invention resides in the claims hereinafter appended.

What is claimed is:

1. A dispensing valve cap for use with a bottle containing fluid for dispensing the fluid in a gravity feed fluid dispensing system comprising:

first and second valve parts cooperating to define an openable and closeable air inlet and fluid outlet;

the first valve part mountable to the bottle, the first valve part including a surface portion defining at least one locking tab, the first valve part defining a longitudinal axis, the locking tab movable in a direction of the longitudinal axis; and the second valve part mounted to the first valve part for rotational movement relative to the first valve part about the longitudinal axis to open and close the air inlet and fluid outlet, the second valve part including a mating portion adapted to cooperate with the first valve part to open and close the air inlet and the fluid outlet, the second valve part further including a locking notch, wherein the locking tab is positionable in the locking notch to lock the second valve part and the first valve part from relative rotation, and wherein the locking tab is positionable out of the locking notch to permit rotation of the second valve part.

2. The dispensing valve cap of claim 1, further comprising a bottle mounted to the first valve part, and a dispenser assembly including:

a main body having a top surface and a sidewall portion defining a valve cap chamber receiving at least a portion of the valve cap, the main body including a hold down arrangement for holding the second valve part from movement relative to the main body;

a dilutant inlet to the main body;

a dilutant valve controlling flow of dilutant from the dilutant inlet into the main body;

a mixing chamber in fluid communication with the dilutant valve and the valve cap chamber; and a fluid outlet in fluid communication with the mixing chamber.

3. The dispensing valve cap of claim 2, wherein the hold down arrangement includes the valve cap chamber defining a notch, and further comprising a side projection extending radially outward from the second valve part received in the notch of the dispenser assembly, the top surface of the main body of the dispenser assembly operative in moving the locking tab from the locking notch upon downward movement of the valve cap in the valve cap chamber.

4. The dispensing valve cap of claim 1, further comprising a camming arrangement mounting the second valve part to the first valve part, wherein rotational movement of the second valve part relative to the first valve part results in movement of the second valve part along the longitudinal axis relative to the first valve part.

5. The dispensing valve cap of claim 4, wherein the camming arrangement includes a post on the first valve part, and a camming surface on the second valve part, the camming surface including a circumferential surface portion about the longitudinal axis resulting in only relative rotational movement of the first and second valve parts as the post is initially moved along the camming surface, the camming surface further including an angled surface portion resulting in relative rotational and longitudinal movement of the first and second valve parts as the post is moved further along the camming surface.

6. A method of dispensing fluid comprising the steps of:

providing a bottle containing fluid therein, the bottle having a valve in fluid communication with an interior of the bottle, the valve having an air inlet and a fluid outlet, the air inlet disposed above the fluid outlet, the valve having a first tubular member oriented vertically, the first tubular member having an air inlet aperture;

rotating and longitudinally moving a second tubular member of the valve mounted adjacent to the first tubular member to simultaneously open the air inlet and the fluid outlet of the valve to dispense the fluid from the bottle under gravity, and allow air to enter the bottle from the atmosphere, the second tubular member including an air inlet aperture alignable with the air inlet aperture of the first tubular member to form the air inlet of the valve;

mixing the fluid dispensed from the bottle with dilutant; and rotating and longitudinally moving the second tubular member to simultaneously close the air inlet and the fluid outlet of the valve.

7. A method of dispensing fluid comprising the steps of:

providing a bottle containing fluid therein, the bottle having a valve in fluid communication with an interior of the bottle;

mounting the bottle to a dispenser assembly;

engaging a longitudinally movable locking tab of the valve with the dispenser assembly to unlock the valve during mounting of the bottle to the dispenser assembly;

rotating a first portion of the unlocked valve relative to a second portion of the valve;

dispensing the fluid from the bottle under gravity through the unlocked and rotated valve, and allowing air to enter the bottle from the atmosphere; and mixing the fluid dispensed from the bottle with dilutant supplied by the dispenser assembly.

* * * * *

UNITED STATES PATENT AND TRADEMARK OFFICE

CERTIFICATE OF CORRECTION

PATENT NO. : 6,354,346 B2
DATED : March 12, 2002
INVENTOR(S) : Arsenault, Cathleen M.

It is certified that error appears in the above-identified patent and that said Letters Patent is hereby corrected as shown below:

Column 2,
Line 14, “beverage” should read -- Beverage --

Column 5,
Line 38, “and” should read -- end --

Signed and Sealed this

Twenty-fifth Day of March, 2003

JAMES E. ROGAN
*Director of the United States Patent and Trademark Office*